US012146669B2

(12) United States Patent
Yu et al.

(10) Patent No.: US 12,146,669 B2
(45) Date of Patent: Nov. 19, 2024

(54) WINDOW AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Hui Yu, Foshan (CN); Zhigang Xing, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 139 days.

(21) Appl. No.: 17/788,186

(22) PCT Filed: Sep. 23, 2020

(86) PCT No.: PCT/CN2020/117204

§ 371 (c)(1),
(2) Date: Jun. 22, 2022

(87) PCT Pub. No.: WO2021/135434

PCT Pub. Date: Jul. 8, 2021

(65) Prior Publication Data

US 2023/0050364 A1 Feb. 16, 2023

(30) Foreign Application Priority Data

Dec. 31, 2019 (CN) ..... 201922494022.9
Dec. 31, 2019 (CN) ..... 201922496573.9
(Continued)

(51) Int. Cl.
*F24F 1/027* (2019.01)
*F24F 1/028* (2019.01)
(Continued)

(52) U.S. Cl.
CPC ..... *F24F 1/027* (2013.01); *F24F 1/028* (2019.02); *F24F 1/031* (2019.02); *F24F 13/30* (2013.01)

(58) Field of Classification Search
CPC .. F24F 1/027; F24F 1/031; F24F 13/30; F24F 1/028; F24F 1/0323; F28F 9/0131; F28F 1/10; F28F 1/12; F28F 9/0229
See application file for complete search history.

(56) References Cited

U.S. PATENT DOCUMENTS

2007/0044495 A1* 3/2007 Kim ..... F24F 1/027 62/262

FOREIGN PATENT DOCUMENTS

CN 201122114 Y * 9/2008
CN 202835726 U 3/2013
(Continued)

OTHER PUBLICATIONS

CN-202835730-U Translation (Year: 2013).*
(Continued)

*Primary Examiner* — Schyler S Sanks
(74) *Attorney, Agent, or Firm* — Anova Law Group, PLLC

(57) ABSTRACT

An indoor heat exchanger includes a heat exchanger shell, a side plate structure including shell side plates arranged at both ends of the heat exchanger shell, heat exchange fins installed at the shell side plates provided in the heat exchanger shell, refrigerant pipes passing through the heat exchange fins, and connection pipes protruding from an end of the heat exchanger shell and each connected to ends of two refrigerant pipes on same side.

20 Claims, 36 Drawing Sheets

(30) Foreign Application Priority Data

| | | |
|---|---|---|
| Dec. 31, 2019 | (CN) | 201922496611.0 |
| Dec. 31, 2019 | (CN) | 201922501080.X |
| Dec. 31, 2019 | (CN) | 201922501488.7 |
| Dec. 31, 2019 | (CN) | 201922501584.1 |

(51) Int. Cl.
*F24F 1/031* (2019.01)
*F24F 13/30* (2006.01)

(56) References Cited

FOREIGN PATENT DOCUMENTS

| | | | | |
|---|---|---|---|---|
| CN | 202835730 | U | * | 3/2013 |
| CN | 108344158 | A | | 7/2018 |
| CN | 208025643 | U | * | 10/2018 |
| CN | 210862959 | U | | 6/2020 |
| CN | 211261047 | U | | 8/2020 |
| CN | 211261065 | U | | 8/2020 |
| CN | 211345576 | U | | 8/2020 |
| JP | 2003056860 | A | | 2/2003 |

OTHER PUBLICATIONS

World Intellectual Property Organization (WIPO) International Search Report and Written Opinion for PCT/CN2020/117204 Dec. 21, 2020 22 Pages (with translation).

* cited by examiner

A

B

I

WINDOW AIR CONDITIONER

CROSS-REFERENCE TO RELATED APPLICATIONS

This application is a National Stage Entry under 35 U.S.C. § 371 of International Application No. PCT/CN2020/117204, filed on Sep. 23, 2020, which claims priority to Chinese Patent Application No. 201922496611.0, entitled "WINDOW AIR CONDITIONER," Chinese Patent Application No. 201922494022.9, entitled "WINDOW AIR CONDITIONER," Chinese Patent Application No. 201922496573.9, entitled "HEAT EXCHANGER ASSEMBLY AND AIR CONDITIONER," Chinese Patent Application No. 201922501488.7, entitled "HEAT EXCHANGER SIDE PLATE, HEAT EXCHANGER AND WINDOW AIR CONDITIONER," Chinese Patent Application No. 201922501584.1, entitled "HEAT EXCHANGER ASSEMBLY OF WINDOW AIR CONDITIONER AND WINDOW AIR CONDITIONER HAVING THE SAME," and Chinese Patent Application No. 201922501080.X, entitled "TEMPERATURE DETECTION ASSEMBLY AND AIR CONDITIONER," all filed on Dec. 31, 2019, the entire contents of all of which are incorporated herein by reference.

TECHNICAL FIELD

The present disclosure relates to the technical field of air conditioners, and in particular, to a window air conditioner.

BACKGROUND

Nowadays, window air conditioners are increasingly widely used due to their convenient use and simple installation. During the production and assembly process of the air conditioner, the indoor air duct shell and the indoor heat exchanger need to be installed at the chassis and the indoor water pan. However, in the conventional technology, the indoor air duct shell and the indoor heat exchanger are separately installed at the indoor water pan, and the assembly efficiency is low.

In the conventional technology, side plates are provided at both ends of the heat exchanger of the air conditioner, which is convenient for installing the heat exchanger on other structures through the side plates, and also for passing the connection pipes at both ends of the heat exchanger on the side plates. With the operation of the air conditioner, condensed water will be generated on the connection pipes at both ends of the heat exchanger, and the condensed water will accumulate at the position where the connection pipes are installed at the side plate. However, in the conventional technology, since the condensed water accumulated on the side plate of the heat exchanger cannot conduct water well, condensed water may spill out of the chassis, resulting in product quality problems and a bad experience for customers. The condensed water generated on the part where the refrigerant pipe of the evaporator matches the side plate may flow out of the water pan along the side plate, as a result, the condensed water on the evaporator will drip onto other parts of the air conditioner, causing a safety hazard or possibly falling on the indoor floor.

In addition, in the conventional technology, a display box is provided at the front of the air conditioner to display the running status of the air conditioner. Moreover, the front end of the air conditioner is also provided with an indoor heat exchanger, which makes the indoor heat exchanger and the pipeline at the end of the indoor heat exchanger relatively close to the display box, so that the connection wires of the display box are relatively close to the pipeline. With the operation of the air conditioner, condensed water will be generated on the pipelines at both ends of the indoor heat exchanger, and the connection wires of the display box near the pipelines will lead to water diversion. Condensed water may be introduced into the display box or other electrical devices connected to the connection wires, which will cause safety hazards to the display box and other electrical devices and affect product quality.

Furthermore, a temperature detector is often provided at the heat exchanger of the air conditioner to detect the temperature of the heat exchanger, but the temperature detector is difficult to replace and maintain.

SUMMARY

Based on this, the present disclosure provides a window air conditioner, which aims to solve at least one of the above-mentioned problems in the conventional technology.

To achieve the above purpose, the present disclosure proposes the following technical solutions.

The present disclosure provides a window air conditioner, including:

a chassis;

an indoor water pan installed at the chassis;

a support frame provided at the chassis or the indoor water pan;

an indoor heat exchanger installed at the support frame and located above the indoor water pan; and an indoor air duct shell installed at the indoor heat exchanger, the indoor heat exchanger is located between the support frame and the indoor air duct shell.

In an embodiment, the support frame is detachably installed at the indoor water pan; or the support frame is integrated with the indoor water pan.

In an embodiment, the support frame is inclined downward from an indoor side to an outdoor side, the indoor heat exchanger is installed at the support frame obliquely, and the indoor air duct shell is installed at the indoor heat exchanger obliquely.

In an embodiment, the support frame includes two support ribs arranged at two sides of the indoor water pan, and two sides of the indoor heat exchanger are respectively installed at the two support ribs.

In an embodiment, the indoor air duct shell includes a shell connection plate connected to the indoor heat exchanger, one side of the indoor heat exchanger is connected to the support frame, another side of the indoor heat exchanger is provided with a heat exchanger backboard, and the heat exchanger backboard is detachably connected to the shell connection plate.

In an embodiment, the indoor heat exchanger includes a heat exchanger shell, heat exchange fins provided in the heat exchanger shell, refrigerant pipes passing through the heat exchange fins, and connection pipes protruding from an end of the heat exchanger shell, and each of the connection pipes is connected to ends of the two refrigerant pipes on a same side;

the window air conditioner further includes a side plate structure including shell side plates arranged at both ends of the indoor heat exchanger shell, the connection pipes are installed at the shell side plates;

each shell side plate is provided with a pipe installation hole, a pipe installation ring protrudes from an outer side of the shell side plate, the pipe installation ring is around the pipe installation hole, the connection pipe passes through the pipe installation hole, or passes through the pipe installation hole and clamped in the pipe installation ring, a bottom of the pipe installation ring is provided with an outer water guide groove, and a cavity formed by the pipe installation ring is communicated with outside through the outer water guide groove.

In an embodiment, the shell side plate is provided with the pipe installation holes, a portion of the pipe installation holes are provided with the pipe installation ring, and each of the pipe installation holes corresponds to one of the connection pipes.

In an embodiment, a bottom surface of the outer water guide groove is recessed on an outer surface of the shell side plate; or a bottom surface of the outer water guide groove is flush with an outer surface of the shell side plate; or a bottom surface of the outer water guide groove is a plane; or a bottom surface of the outer water guide groove is an inclined surface, and the inclined surface is inclined from the pipe installation hole to an outside of the pipe installation ring.

In an embodiment, the pipe installation hole includes a first pipe installation hole and a second pipe installation hole respectively provided at the shell side plate, and the pipe installation ring is provided outside the first pipe installation hole;

a portion of the connection pipe is installed in the first pipe installation hole and clamped in the pipe installation ring, and another portion of the connection pipe is installed in the second pipe installation hole;

a bottom of each first pipe installation hole is provided with an inner water guide groove, and the inner water guide groove is communicated with a first pipe installation hole and a second pipe installation hole adjacent to the first pipe installation hole; or a bottom of each first pipe installation hole is provided with the inner water guide groove, the inner water guide groove is communicated with two adjacent first pipe installation holes, and one of the two adjacent first pipe installation holes is communicated with a second pipe installation hole adjacent to the one of the two adjacent first pipe installation holes through one of the inner water guide grooves.

In an embodiment, the indoor heat exchanger includes a heat exchanger body and a side plate provided at the heat exchanger body;

the side plate includes a side plate body, and matching holes are formed at the side plate body to match a refrigerant pipe of the heat exchanger;

a periphery of each of at least some of the matching holes is formed with a protective protrusion, and the protective protrusion is located at a side of the side plate body away from the heat exchanger body; and the protective protrusion extends along a circumferential direction of the matching hole, and a water leakage hole is formed at the protective protrusion.

In an embodiment, the water leakage hole is formed at a lowest position of the protective protrusion; or the water leakage hole is a notch formed at the protective protrusion.

In an embodiment, the side plate body includes a first sub-side plate body and a second sub-side plate body, an angle is formed between the first sub-side plate body and the second sub-side plate body, and the angle is 30°-50°.

In an embodiment, the window air conditioner further includes:

a heat exchanger including a heat exchanger body and a pipeline communicated with the heat exchanger body; and a water-blocking structure connected to the heat exchanger body and configured to shield the pipeline to isolate the pipeline from a connection wire.

In an embodiment, the refrigerant connection pipe is connected to one end of the heat exchanger body along a left-right direction, the one end of the heat exchanger body is provided with an elbow member, the water baffle structure is provided with a clamp groove, and the clamp groove is clamped with the elbow member.

In an embodiment, the water baffle structure is located on one side of the one end of the heat exchanger body, and the water baffle structure includes:

a water-blocking connection member and a water-blocking side plate, the water-blocking connection member and the water-blocking side plate being spaced apart in a left-right direction and arranged opposite to each other, the water-blocking connection member being located between the water-blocking side plate and the one end of the heat exchanger body, the water-blocking connection member is provided with the clamp groove; and a water-blocking main plate, the water-blocking main plate being connected between a front end of the water-blocking connection member and a front end of the water-blocking side plate to form an accommodation space with the water-blocking connection member and the water-blocking side plate, a portion of the refrigerant connection pipe being located in the accommodation space and extending in an up-down direction.

In an embodiment, the water baffle structure further includes a deflector connected to a lower end of the water-blocking main plate and extending downward, and a width of the deflector is smaller than a width of the water-blocking main plate.

In an embodiment, the window air conditioner further includes:

a housing installed at the chassis;

an electric control box installed in the housing; and a display box installed at the housing and electrically connected to the electric control box through the connection wire.

In an embodiment, the window air conditioner further includes:

a temperature detection assembly including:

a fixation shell which is a heat-conduction member;

a temperature detection member provided in the fixation shell and in contact with the fixation shell, the fixation shell having an installation port for removing and installing the temperature detection member; and a fixation member provided at the fixation shell and configured for detachably fixing the temperature detection member in the fixation shell.

In an embodiment, the fixation member includes an elastic press member located in the fixation shell, and at least a part of the elastic press member is bent towards the temperature detection member to elastically press the temperature detection member in the fixation shell.

In an embodiment, the fixation member is detachably provided at the fixation shell, the fixation member includes a buckle member, the buckle member is connected to an upper end of the elastic press member and protrudes outward to an outside of the fixation shell, the buckle member is connected to the elastic press member through a connection member, the connection member is supported on the fixation shell, and the buckle member includes:

a first buckle section connected to the upper end of the elastic press member and extending outward; and a second buckle section connected to an end of the first buckle section away from the elastic press member and extending downward, at least a part of the second buckle section being spaced apart from the fixation shell to form a buckle space, the second buckle section being bent toward the fixation shell to elastically press on the fixation shell.

In technical solutions of the present disclosure, the support frame is provided at the chassis or the indoor water pan, the indoor heat exchanger is directly installed at the support frame as a whole, and then the indoor air duct shell is installed at the indoor heat exchanger as a whole. Compared with the traditional technology in which the indoor heat exchanger and the indoor air duct shell are respectively installed at the chassis and the indoor water pan, the present disclosure can realize the integrated installation of the indoor heat exchanger and the indoor air duct shell, and the installation efficiency is higher. The support frame, indoor heat exchanger and indoor air duct shell are installed layer by layer from bottom to top, which is convenient for production assembly and foolproof assembly.

The outer water guide groove is provided at the bottom of the pipe installation ring, the condensed water accumulated in the pipe installation ring can be guided to the shell side plate through the outer water guide groove in time, such that the condensed water can fall along the outer surface of the shell side plate, and will not fall outside the chassis, which will not cause product quality problems, and can bring users a good experience.

Besides, a water baffle structure is provided between the display box and the indoor heat exchanger, and the connection wires connecting the display box and the electric control box are isolated from the pipelines at the end of the indoor heat exchanger. The indoor heat exchanger generates the cold energy and condensed water on the pipelines during the working process. The cold energy and condensed water will not be transmitted to the connection wire, so that the condensed water will be generated on the connection wire, and then the condensed water will be guided into the display box to threaten the safety of the display box. In this way, the connection wires connecting the display box and the indoor heat exchanger and the pipelines are isolated by the water baffle structure, so that the use safety of the display box can be ensured.

The fixation member is used to detachably fix the temperature detection member in the fixation shell, so that the temperature detection member is easy to be removed and installed, which is convenient for the replacement and maintenance of the temperature detection member.

BRIEF DESCRIPTION OF THE DRAWINGS

In order to more clearly illustrate the embodiments of the present disclosure or the technical solutions in the existing technologies, the following briefly introduces the accompanying drawings that need to be used in the description of the embodiments or the existing technologies. Obviously, the drawings in the following description are only some embodiments of the present disclosure. For those of ordinary skill in the art, other drawings can also be obtained based on the structures shown in these drawings without any creative effort.

DESCRIPTION OF REFERENCE CHARACTERS

Figure 1:
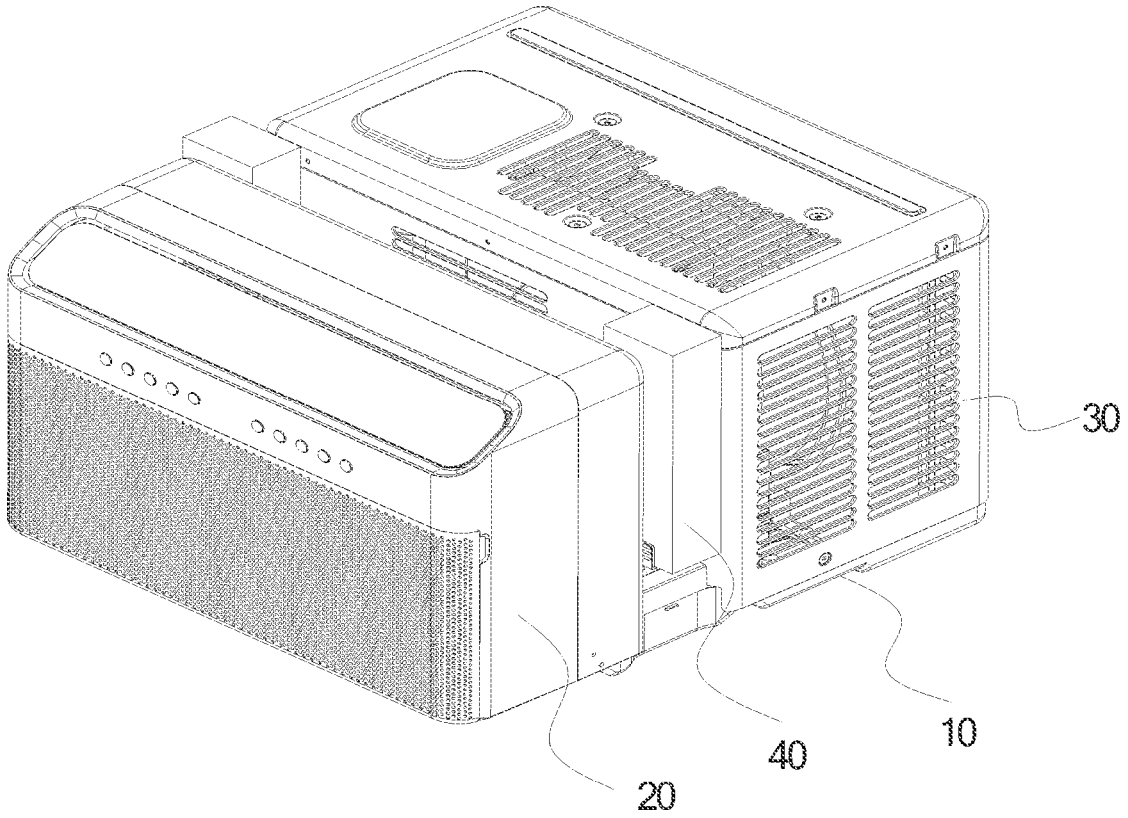
FIG. 1 is a schematic three-dimensional structural view of a window air conditioner according to some embodiments of the present disclosure (when the sealing member is in a storage state).

| reference characters | name | reference characters | name |
|---|---|---|---|
| 10, 2, 95 | chassis | 20, 101a | indoor housing |
| 22 | cross-flow fan wheel | 24 | display box |
| 26 | indoor motor | 30, 102a | outdoor housing |
| 32 | electric control box | 34 | outdoor motor |
| 35 | compressor | 36 | axial flow fan blade |
| 38 | outdoor heat exchanger | 40 | sealing member |
| 50 | partition groove | 100, 3, 60 | indoor water pan |
| 110 | water pan positioning column | 200 | support frame |
| 210 | support rib | 212 | support-limit groove |
| 300, 1 | indoor heat exchanger | 302 | heat exchanger back plate |
| 310 | heat exchanger body | 312 | heat exchanger connection side plate |
| 320 | heat exchanger sub-section | 330 | heat exchanger protrusion |
| 340 | heat exchanger screw connection seat | 350 | back plate screw connection seat |
| 400 | indoor air duct shell | 410 | shell connection plate |
| 420 | shell flange plate | 430 | shell screw connection seat |
| 360, 12 | side plate structure | 362 | shell side plate |
| 364 | side plate retaining ring | 366 | first pipe installation hole |
| 368 | second pipe installation hole | 369 | inner water guide groove |
| 370 | pipe installation ring | 372 | outer water guide groove |
| 380 | clamping plate | 3642 | retaining ring opening |
| 80, 80a | water baffle structure | 82, 82a | water-blocking side plate |
| 81, 81a | water-blocking main plate | 83, 83a | water-blocking connection member |
| 242 | connection wire | 252 | pipe member |
| 2522 | connection pipe | 2524 | refrigerant pipe |
| 11 | heat exchanger body | 111 | elbow member |
| 121 | side plate body | 1211 | matching hole |
| 122 | protective protrusion | 12a | second side plate |
| 1212 | first sub-side plate body | 1213 | second sub-side plate body |
| 1221 | water leakage hole | 31 | first support plate |
| 33 | second support plate | 4, 92 | face frame |
| 41, 921 | air inlet | 42, 922 | air outlet |
| 43, 923 | air inlet panel | 431, 9231 | ventilation structure |
| 1000 | window air conditioner | 101 | indoor portion |
| 102 | outdoor portion | 1000a | heat exchanger assembly |
| 211 | clamp groove | 111 | elbow member |
| 25 | deflector | 212 | guide slope |
| 27 | accommodation space | 37 | casing |
| 401 | fixation member | 402 | sealing component |
| 51 | positioning device | 70, 96 | indoor fan |
| 2000 | wall | 2001 | window |
| 3000 | shielding member | 91 | temperature detection assembly |
| 911 | fixation shell | 912 | temperature detection member |
| 913 | fixation member | 9131 | elastic press member |
| 9132 | support member | 9133 | buckle member |
| 91331 | first buckle section | 91332 | second buckle section |
| 9134 | connection member | 9135 | buckle space |
| 93 | evaporator | 931 | evaporator refrigerant pipe |
| 94 | condenser | 941 | condenser refrigerant pipe |

The realization of the objective, functional characteristics, and advantages of the present disclosure are further described with reference to the accompanying drawings.

DETAILED DESCRIPTION OF THE EMBODIMENTS

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It should be noted that if there is a directional indication (such as up, down, left, right, front, rear . . . ) in the embodiments of the present disclosure, the directional indication is only used to explain the relative positional relationship, movement, etc. of the components in a certain posture (as shown in the drawings). If the specific posture changes, the directional indication will change accordingly.

It should be noted that, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. In addition, the technical solutions between the various embodiments can be combined with each other, but they must be based on the realization of those of ordinary skill in the art. When the combination of technical solutions is contradictory or cannot be achieved, it should be considered that such a combination of technical solutions does not exist, nor is it within the scope of the present disclosure.

Figure 2:
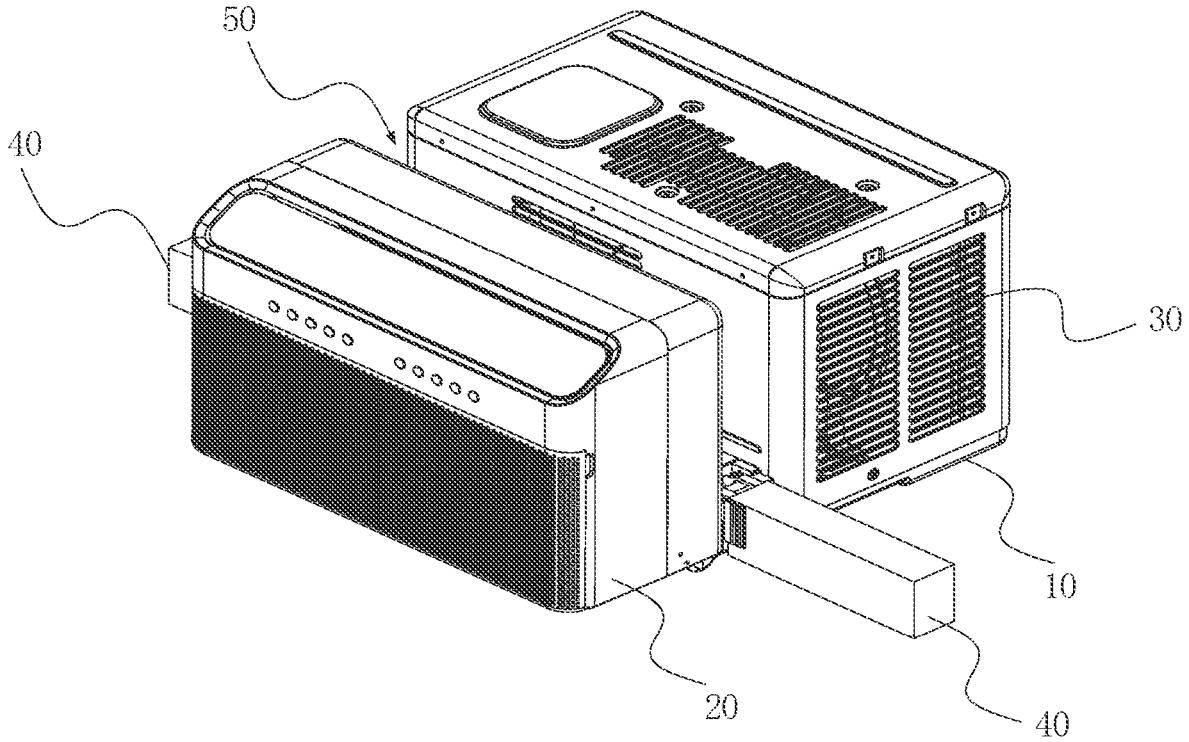
FIG. 2 is a schematic three-dimensional structural view of the window air conditioner shown in FIG. 1 (when the sealing member is in a working state).

As shown in FIG. 1 and FIG. 2, the present disclosure provides a window air conditioner. The window air conditioner includes a chassis 10, and a housing covered on the chassis 10. The housing is provided with a partition groove 50 for the shielding member located at the wall window to extend into, and the partition groove 50 can separate the housing into an indoor housing 20 and an outdoor housing 30. An indoor cavity is formed inside the indoor housing 20, and an outdoor cavity is formed inside the outdoor housing 30. An indoor assembly is provided in the indoor cavity, and an outdoor assembly is provided in the outdoor cavity. The window air conditioner can include a sealing member 40 movably installed at the partition groove 50 for switching between a storage state and a working state. In the storage state, the sealing member 40 is stored in the partition groove 50 (as shown in FIG. 1). In the working state, the sealing member 40 laterally protrudes out of the partition groove 50 (as shown in FIG. 2), and is used for the shielding member and/or the inner wall of the wall window to abut. The above-mentioned sealing member can be shutters, curtains, or window shutters.

Figure 3:
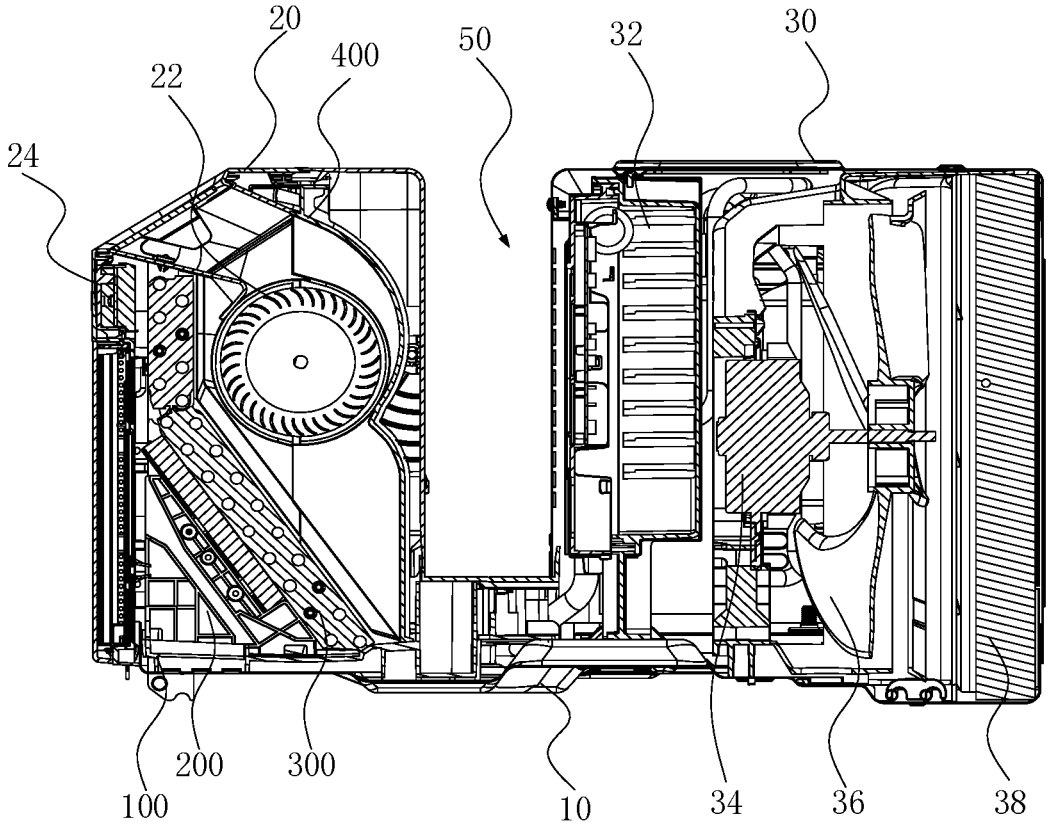
FIG. 3 is a schematic cross-sectional structural view of the window air conditioner according to some embodiments of the present disclosure.
Figure 4:
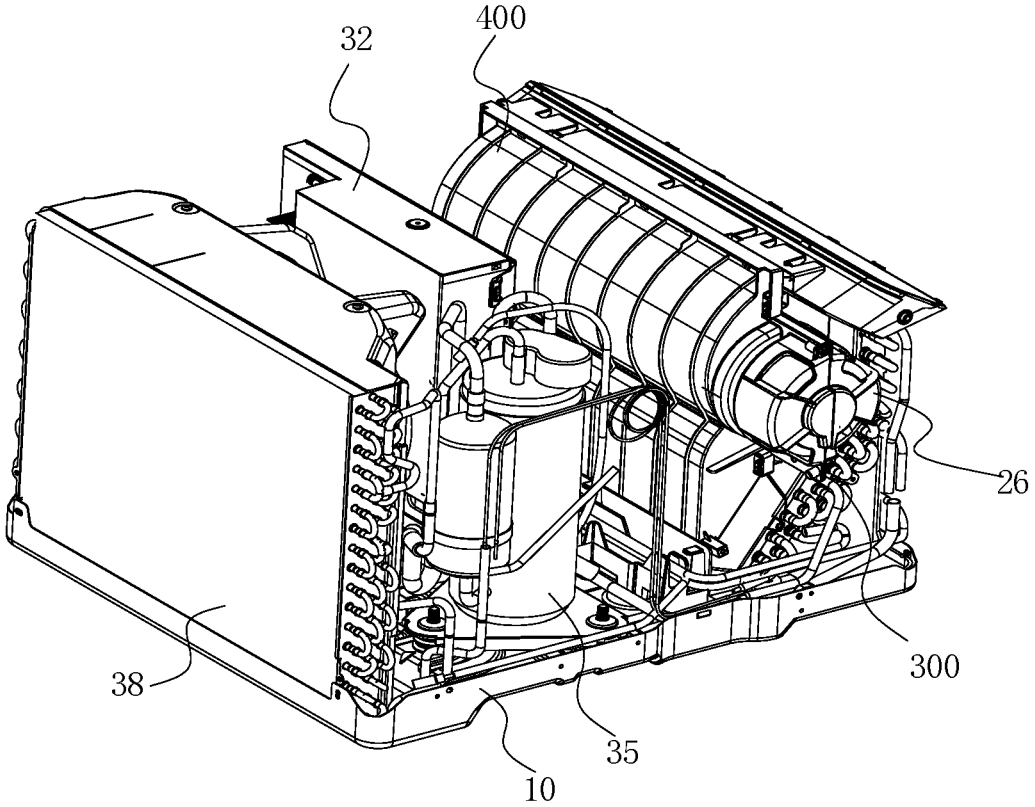
FIG. 4 is a schematic three-dimensional structural view of the window air conditioner according to some embodiments of the present disclosure (when the housing is removed).

Besides, as shown in FIG. 3 and FIG. 4, the outdoor assembly can include an electric control box 32 provided in the outdoor cavity, an outdoor motor 34, a compressor 35, an axial flow fan blade 36, an outdoor heat exchanger 38 and other structures. The indoor assembly can include an indoor air duct assembly disposed in the indoor cavity, a display box 24 (which can be installed at the indoor housing 20), an indoor heat exchanger 300, and other structures. The indoor air duct assembly can be installed at the chassis 10 and located in the indoor housing 20 of the housing. The indoor air duct assembly can include an indoor air duct shell 400 mounted on the chassis 10 and located in the indoor housing 20, an indoor motor 26 provided at the indoor air duct shell 400, and the cross-flow fan wheel 22 provided in the indoor air duct shell 400 and connected to the indoor motor.

Figure 5:
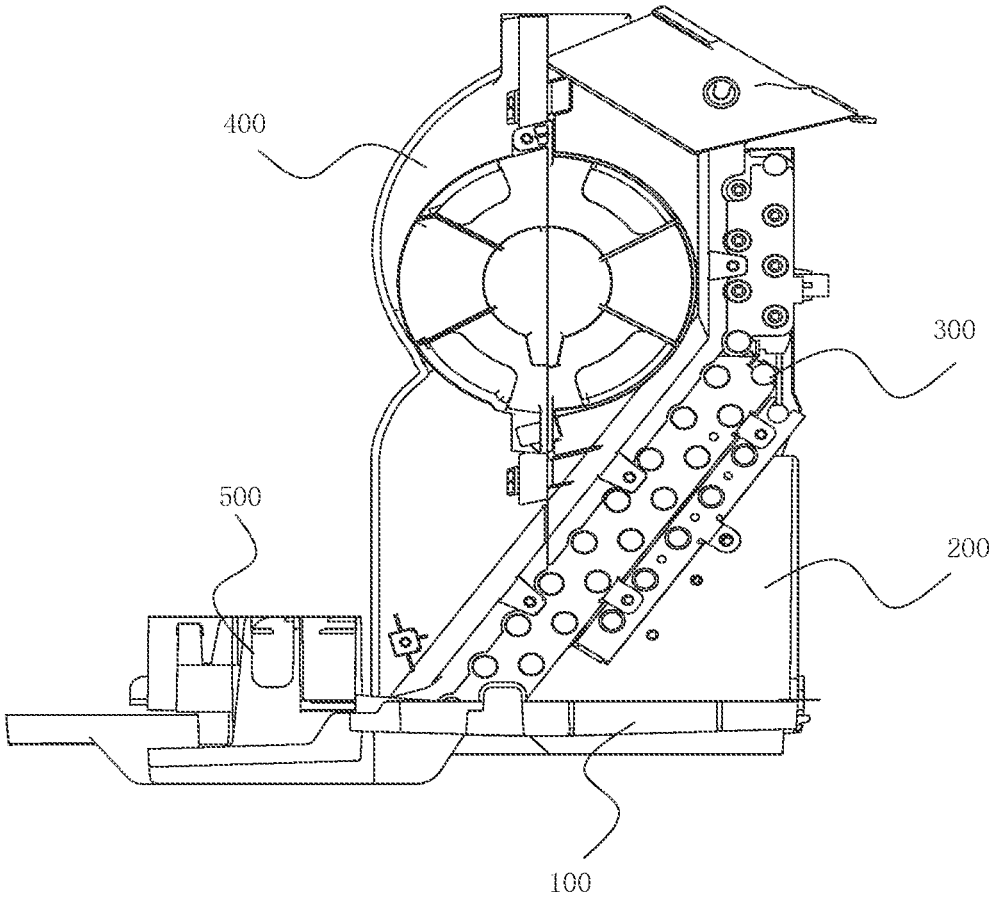
FIG. 5 is a schematic structural side view of an indoor heat exchanger and an indoor air duct shell provided at an indoor water pan of the window air conditioner according to some embodiments of the present disclosure.
Figure 6:
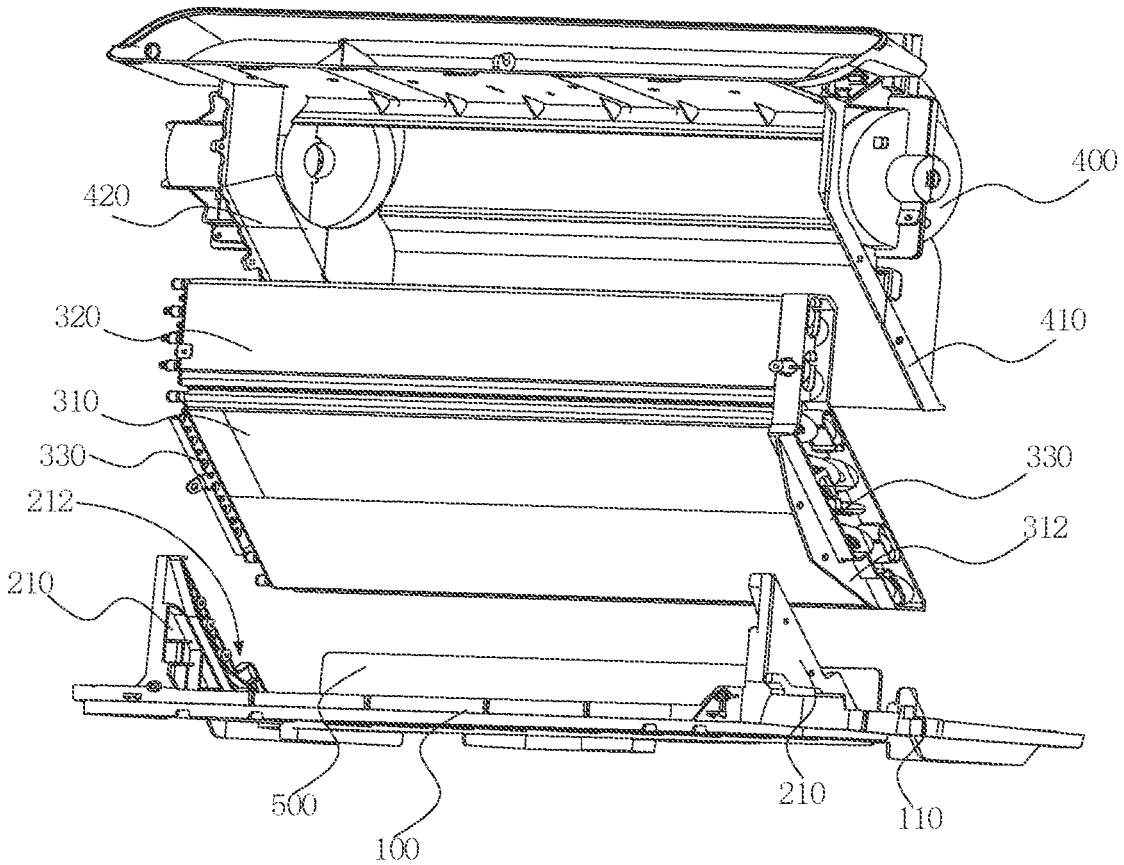
FIG. 6 is a schematic exploded structural view of an indoor heat exchanger and an indoor air duct shell provided at the indoor water pan of the window air conditioner according to some embodiments of the present disclosure.
Figure 7:
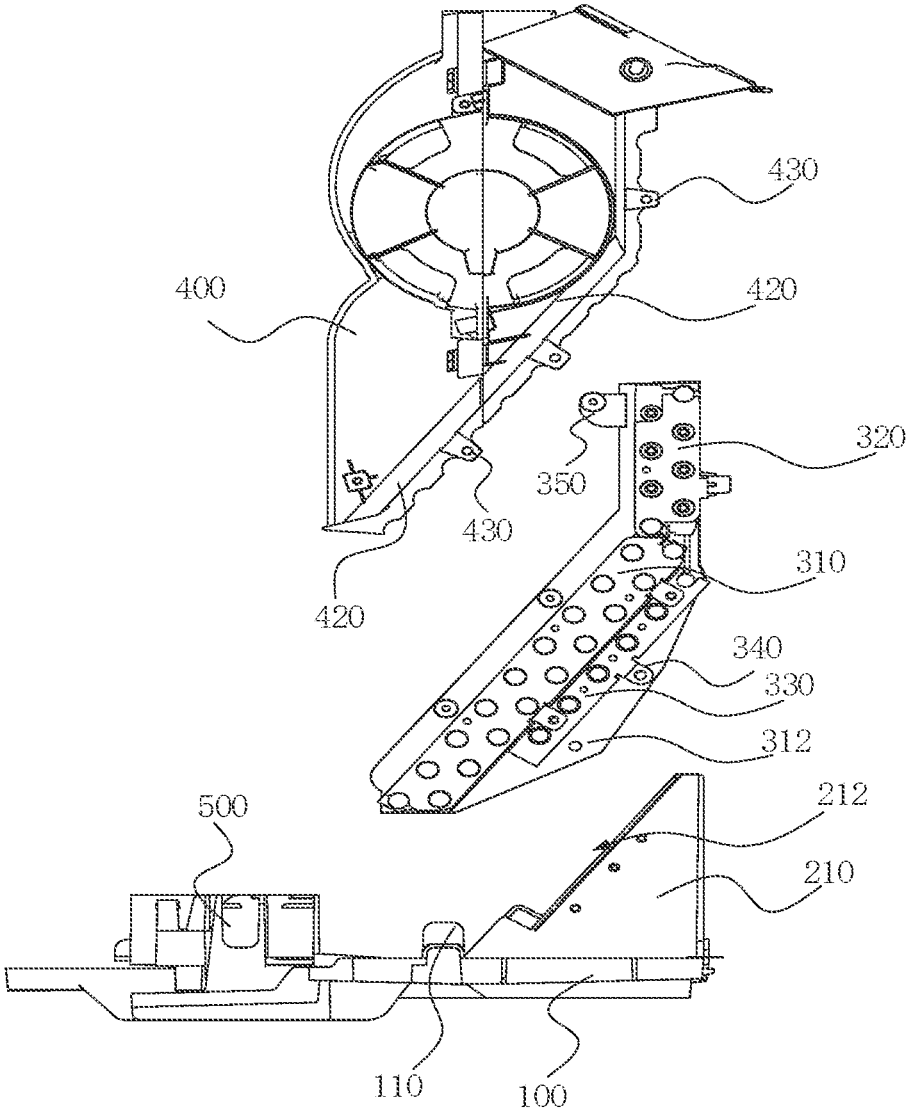
FIG. 7 is a schematic structural side view of FIG. 6.
Figure 8:
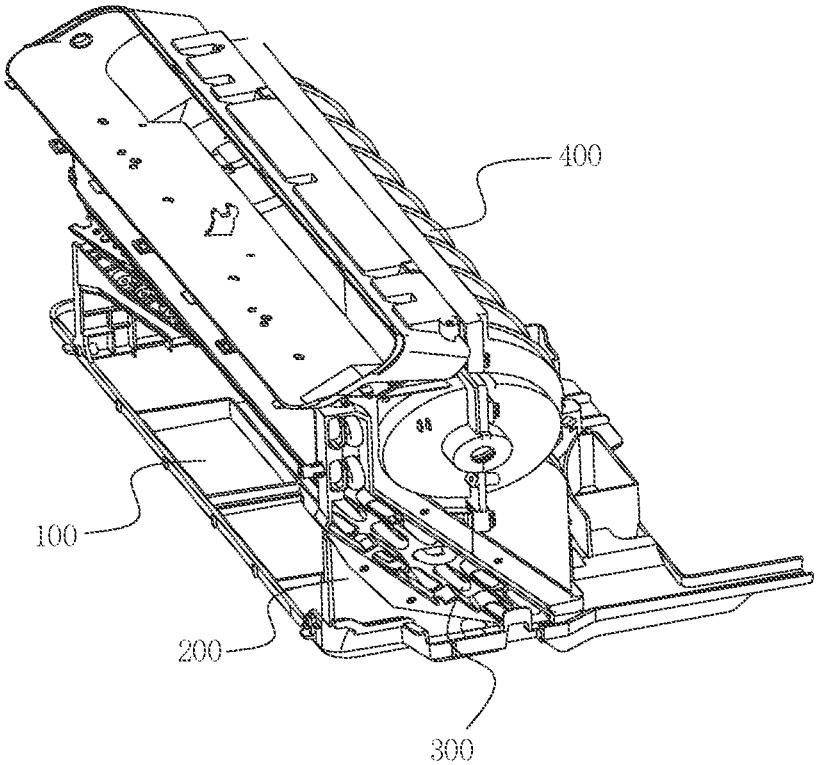
FIG. 8 is a schematic three-dimensional structural view of the indoor heat exchanger of the window air conditioner according to some embodiments of the present disclosure being disposed on the indoor water pan.

As shown in FIG. 5 to FIG. 7, an indoor water pan 100 is also installed at the indoor side of the chassis 10. A support frame 200 is also obliquely installed at the chassis 10 or the indoor water pan 100, and the indoor heat exchanger 300 is installed at the support frame 200 and located above the indoor water pan 100. The indoor air duct shell 400 is installed at the indoor heat exchanger 300. The indoor water pan 100, the support frame 200, the indoor heat exchanger 300 and the indoor air duct shell 400 are all located in the indoor cavity. The indoor heat exchanger 300 is located between the support frame 200 and the indoor air duct shell 400. The support frame 200 is provided at the chassis 10 or the indoor water pan 100, the indoor heat exchanger 300 is directly installed at the support frame 200 as a whole, and the indoor air duct shell 400 is installed at the indoor heat exchanger 300 as a whole. Compared with the conventional technique of installing the indoor heat exchanger 300 and the indoor air duct shell 400 on the chassis 10 and the indoor water pan 100, respectively, the present disclosure can realize the integrated installation of the indoor heat exchanger 300 and the indoor air duct shell 400, and the installation efficiency is higher. The support frame 200, the indoor heat exchanger 300, and the indoor air duct shell 400 are sequentially installed layer by layer from bottom to top, which is convenient for production assembly and foolproof assembly.

In this embodiment, the support frame 200 can be installed at the indoor water pan 100. The support frame 200 is provided at the indoor water pan 100, and the installation is more convenient. It is also convenient for the indoor heat exchanger 300 installed at the support frame 200 to be located within the range of the indoor water pan 100, so that the condensed water is not easily overflowed to the outside of the indoor water pan 100. Further, the support frame 200 can be detachably installed at the indoor water pan 100, and the support frame 200 and the indoor water pan 100 can be processed and manufactured separately. The support frame 200 can be integrated with the indoor water pan 100, so that the support frame 200 is firm and stable, and the support is reliable.

The support frame 200 can be inclined downward from the indoor side to the outdoor side, the indoor heat exchanger 300 is installed obliquely on the support frame 200, and the indoor air duct shell 400 is installed obliquely on the indoor heat exchanger 300. The support frame 200 is inclined, and the indoor heat exchanger 300 is installed obliquely on the support frame 200, and the indoor air duct shell 400 is installed obliquely on the indoor heat exchanger 300, such that the support frame 200 supports the indoor heat exchanger 300 and the indoor air duct shell 400 more stably and reliably, which also facilitates the condensed water on the indoor heat exchanger 300 to fall onto the indoor water pan 100.

Further, the indoor heat exchanger 300 can include a heat exchanger body 310 disposed obliquely, and a heat exchanger sub-section 320 protruding from a top of the heat exchanger body 310. The heat exchanger body 310 is correspondingly installed at the support frame 200 disposed obliquely. That is, a part of the indoor heat exchanger 300 can be inclined, and the inclined part can be installed at the inclined support frame 200 correspondingly. In this way, the indoor heat exchanger 300 with a larger volume can be adapted, and the installation of the indoor heat exchanger 300 on the support frame 200 can also be made more stable. Besides, in this embodiment, the heat exchanger sub-section 320 of the indoor heat exchanger 300 can be vertically provided at the top of the heat exchanger body 310, such that when the indoor heat exchanger 300 is installed at the support frame 200, the center of gravity is close to the indoor side of the indoor water pan 100, which is more stable. Furthermore, the indoor air duct shell 400 can include a shell connection plate 410 connected to the indoor heat exchanger 300, and a shape of the shell connection plate 410 corresponds to a shape of the indoor heat exchanger 300. That is, the indoor air duct shell 400 can also be set according to the shape of the indoor heat exchanger 300, the connection member between the shell connection plate 410 of the indoor air duct shell 400 and the heat exchanger body 310 of the indoor heat exchanger 300 is arranged obliquely, and the part connected to the heat exchanger sub-section 320 can be arranged vertically, such that the shape of the indoor air duct shell 400 is more suitable for the shape of the indoor heat exchanger 300, and the connection is convenient, tight and reliable.

The support frame 200 can include support ribs 210 respectively disposed on both sides of the indoor water pan 100, and both sides of the indoor heat exchanger 300 are respectively installed at the two support ribs 210. Support ribs 210 are respectively provided at both sides of the indoor water pan 100, so that the heat exchanger body 310 of the indoor heat exchanger 300 can be connected from both sides, so that the support for the indoor heat exchanger 300 is more stable. Both of the two support ribs 210 are inclined downward from the indoor side to the outdoor side.

Atop end of at least one support rib 210 is provided with a support-limit groove 212. At least one end of the heat exchanger body 310 of the indoor heat exchanger 300 can protrude with a heat exchanger protrusion 330, and the heat exchanger protrusion 330 is correspondingly clamped in the support-limit groove 212. The support-limit groove 212 is provided at the support rib 210, so that the heat exchanger protrusion 330 on the heat exchanger body 310 can be clamped to position the indoor heat exchanger 300, and the support for connecting the indoor heat exchanger 300 can be more stable. The support-limit groove 212 can be provided at one support rib 210, or the support-limit grooves 212 can be provided at both of the two support ribs 210. In addition, one end of the heat exchanger body 310 may be provided with a heat exchanger protrusion 330, and both ends of the heat exchanger body 310 can also be provided with a heat exchanger protrusion 330. Besides, a support protrusion can also be provided at the top of the support rib 210, and a heat exchanger recess can be provided at the heat exchanger body 310 of the indoor heat exchanger 300 to cooperate with the support protrusion.

In some embodiments, the indoor heat exchanger 300 can include a heat exchanger connection side plate 312 protruding from at least one end of the heat exchanger body 310, and each heat exchanger connection side plate 312 is correspondingly connected to a side surface of a support rib 210. That is, the heat exchanger connection side plates 312 can be provided at one end or both ends of the heat exchanger body 310 to connect with the side surfaces of the support ribs 210 correspondingly, so as to fix the heat exchanger body 310 and the support rib 210.

Besides, in another embodiments, the indoor heat exchanger 300 can include a heat exchanger screw connection seat 340 protruding from at least one end of the heat exchanger body 310. Each heat exchanger screw connection seat 340 is connected to the side surface of one support rib 210 through a screw connection. That is, the heat exchanger body 310 can be connected and fixed with the support rib 210 from one end or both ends through the screw connection structure.

Besides, in another embodiments, the heat exchanger connection side plate 312 and the heat exchanger screw connection seat 340 may be provided at the same time, so as to connect and fix the heat exchanger body 310 and the support rib 210.

In this embodiment, the indoor heat exchanger 300 may include a heat exchanger connection side plate 312 protruding from one end of the heat exchanger body 310, and the heat exchanger connection side plate 312 is connected to a side surface of a support rib 210. Moreover, the indoor heat exchanger 300 may further include a heat exchanger screw connection seat 340 protruding from the other end of the heat exchanger body 310, and the heat exchanger screw connection seat 340 is connected to the side surface of the other support rib 210 through a screw connection. That is, one end of the heat exchanger body 310 is provided with a heat exchanger connection side plate 312 to connect with one support rib 210, and a heat exchanger screw connection seat 340 is provided at the other end of the heat exchanger body 310 to connect with another support rib 210. In this way, the heat exchanger body 310 can be positioned from the outside through the heat exchanger connection side plate 312, and then the heat exchanger body 310 can be fixed by the screw connection structure. Further, the heat exchanger connection side plate 312 can extend along the middle or side of the heat exchanger protrusion 330 toward the support rib 210, and the heat exchanger connection side plate 312 is attached to the side surface of the support rib 210. That is, the heat exchanger connection side plate 312 can protrude on the heat exchanger protrusion 330, and the heat exchanger connection side plate 312 and the support ribs 210 can be fitted, and the positioning connection is more convenient and reliable.

In addition, the indoor water pan 100 may protrude with a water pan positioning column 110, and the indoor heat exchanger 300 is provided with a heat exchanger positioning groove corresponding to the water pan positioning column 110. Alternatively, the indoor water pan 100 may be recessed with a water pan positioning groove, and the indoor heat exchanger 300 is provided with a heat exchanger positioning column corresponding to the water pan positioning groove. That is, a positioning structure can be provided between the indoor water pan 100 and the indoor heat exchanger 300 to position the two, which is convenient for subsequent connection and fixing of the two, and can also make the connection between the two more stable and reliable.

The indoor air duct shell 400 includes the shell connection plate 410 connected to the indoor heat exchanger 300. Moreover, the front side of the indoor heat exchanger 300 is connected to the support ribs 210 of the support frame 200. The rear side of the indoor heat exchanger 300 is provided with a heat exchanger back plate 302, and the heat exchanger back plate 302 is detachably connected to the shell connection plate 410. The shell connection plates 410 can be arranged at both sides of the indoor air duct shell 400 and can be connected to both sides of the heat exchanger back plate 302 of the indoor heat exchanger 300. The indoor air duct shell 400 may include a shell flange plate 420 disposed on the shell connection plate 410. The shell flange plate 420 can extend from the side edge of the shell connection plate 410 in a direction away from the end face of the indoor air duct shell 400, and the heat exchanger back plate 302 is detachably connected to the shell flange plate 420. By arranging the shell flange plate 420 on the side of the shell connection plate 410, the connection range of the shell connection plate 410 can be extended, therefore, the indoor air duct shell 400 can be adapted to indoor heat exchangers 300 of different sizes, and has good compatibility.

In addition, the indoor air duct shell 400 may include at least one shell screw connection seat 430 protruding from the shell connection plate 410 or the shell flange plate 420. The shell screw connection seat 430 is detachably connected to the heat exchanger back plate 302 through a screw connection. The indoor heat exchanger 300 may also include at least one back plate screw connection seat 350 protruding from the heat exchanger back plate 302. The back plate screw connection seat 350 is detachably connected to the shell connection plate 410 or the shell flange plate 420 through a screw connection. That is, the indoor air duct shell 400 and the heat exchanger back plate 302 can be connected through the screw connection structure.

The indoor water pan 100 or the chassis 10 is provided with a water pan limit plate 500 protruding laterally. The water pan limit plate 500 and the support frame 200 are respectively disposed on both sides of the integral structure formed by the indoor heat exchanger 300 and the indoor air duct shell 400. A support frame 200 and the water pan limit plate 500 are respectively provided at both sides of the indoor water pan 100, such that the indoor heat exchanger 300 and the indoor air duct shell 400 can be limited from both sides, so as to make the connection and fixation of the two more stable.

Figure 9:
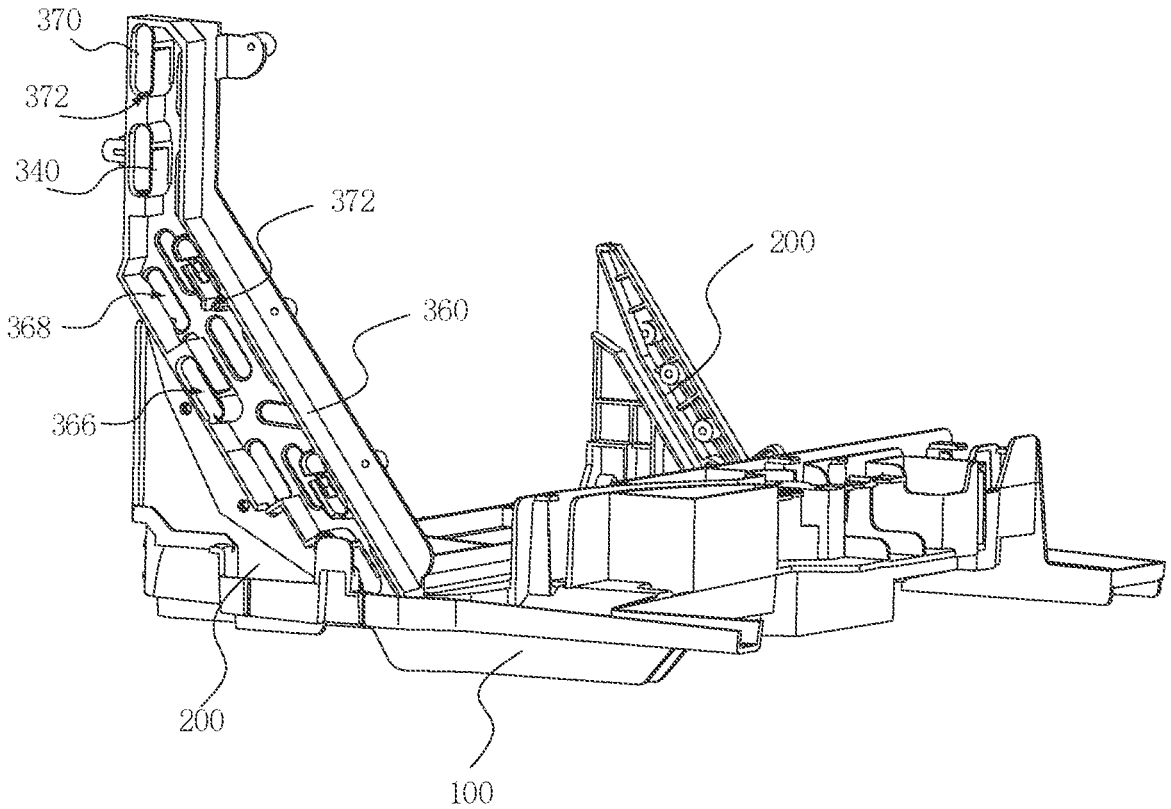
FIG. 9 is a first schematic three-dimensional structural view of the side plate structure of the window air conditioner according to some embodiments of the present disclosure being disposed on the indoor water pan.
Figure 10:
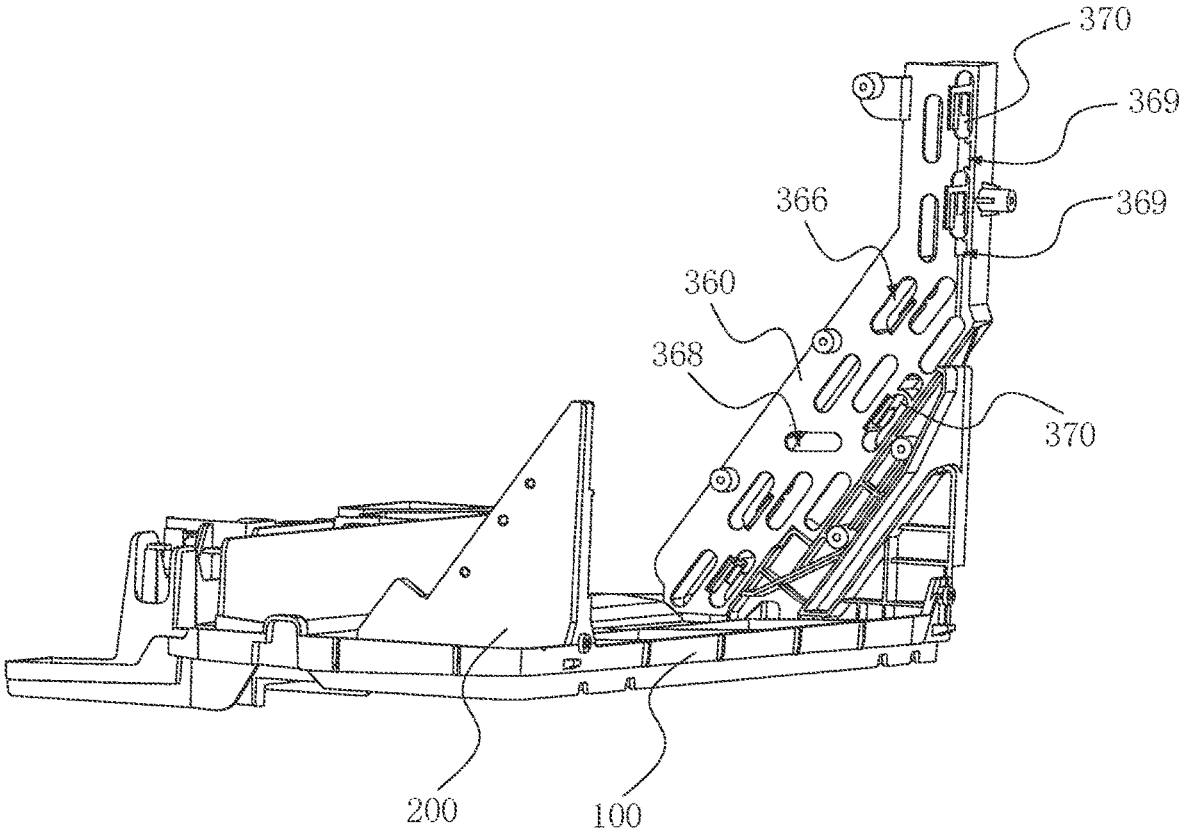
FIG. 10 is a second schematic three-dimensional structural view of a side plate structure of the window air conditioner according to some embodiments of the present disclosure being disposed on the indoor water pan.
Figure 11:
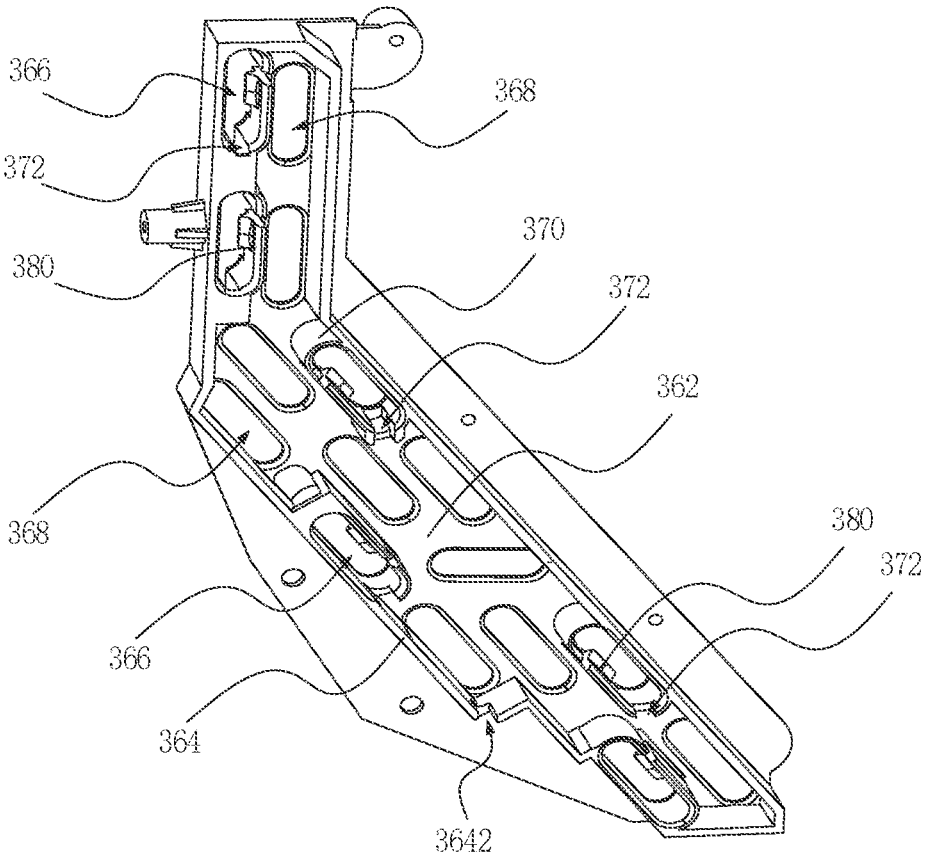
FIG. 11 is a schematic three-dimensional structural view of the side plate structure of the window air conditioner according to some embodiments of the present disclosure.
Figure 12:
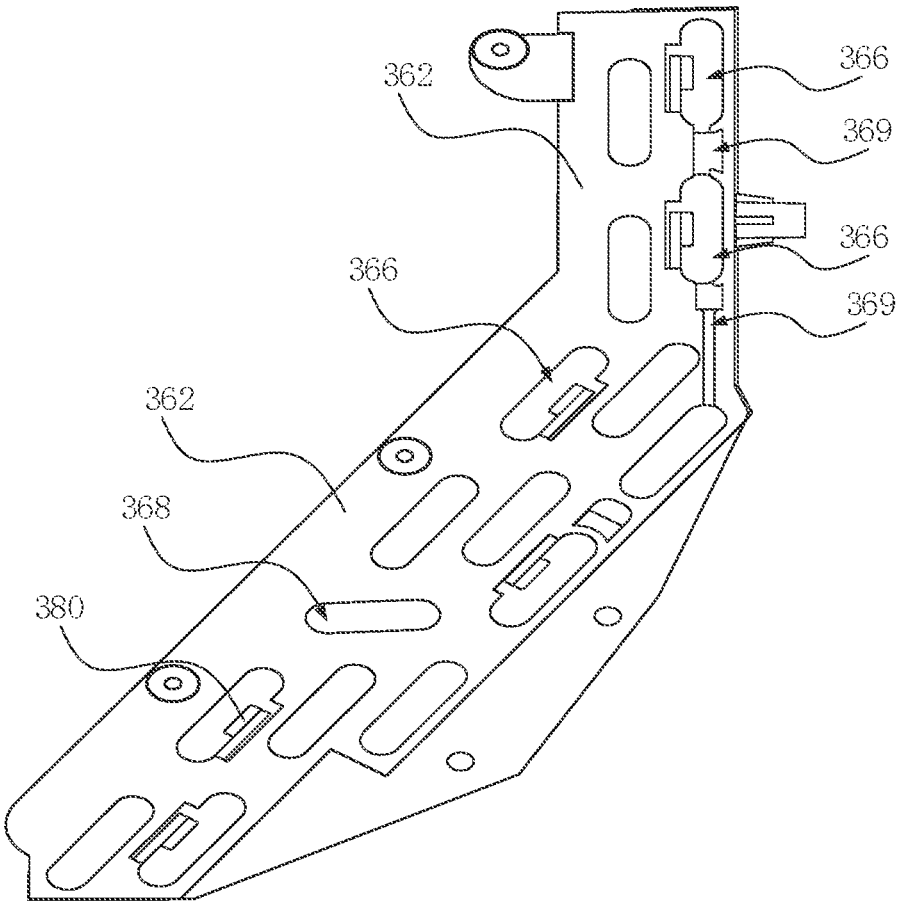
FIG. 12 is a schematic structural rear view of the side plate structure of the window air conditioner according to some embodiments of the present disclosure.

As shown in FIG. 9 and FIG. 12, the indoor heat exchanger 300 further includes a side plate structure 360, the indoor heat exchanger 300 may include a heat exchanger shell, heat exchange fins arranged in the heat exchanger shell, a plurality of refrigerant pipes 2524 arranged in the heat exchange fins, and a plurality of connection pipes 2522 protruding from the end of the heat exchanger shell. Each connection pipe 2522 connects the ends of two refrigerant pipes 2524 located on the same side. The connection pipe 2522 can communicate with the two refrigerant pipes 2524 from the end, such that the cooling medium in the plurality of refrigerant pipes 2524 can circular flow, so as to transfer energy to the heat exchange fins, so as to spread the cooling or heat out.

Besides, as shown in FIG. 9 to FIG. 12, the side plate structure 360 can include shell side plates 362 respectively disposed on both ends of the heat exchanger shell, and the connection pipes 2522 are installed at the shell side plates 362. That is, the shell side plate 362 can not only seal the heat exchanger shell, but also support the connection pipe 2522 in a fixed manner. Further, a plurality of pipe installation holes 366 and 368 are provided at the shell side plate 362. A pipe installation ring 370 protrudes from the outer side of the shell side plate 362, and the pipe installation ring 370 is provided around the pipe installation holes 366 and 368. The connection pipe 2522 passes through the pipe installation hole 366 or 368, or passes through the pipe installation hole 366 or 368 and clamped in the pipe installation ring 370. The bottom of the pipe installation ring 370 is provided with an outer water guide groove 372, and the cavity formed by the pipe installation ring 370 is communicated with the outside world through the outer water guide groove 372. During the operation of the indoor heat exchanger 300, condensed water may be generated on the connection pipe 2522 at the end of the indoor heat exchanger 300. When the connection pipe 2522 is connected in the pipe installation ring 370 protruding from the shell side plate 362, the condensed water generated on the connection pipe 2522 is easy to accumulate inside the pipe installation ring 370, and the condensed water is easy to leak to the outside of the pipe installation ring 370 when the condensed water is fully accumulated. Since the pipe installation ring 370 protrudes outside the shell side plate 362, the leaked condensed water easily falls to the outside of the indoor heat exchanger 300, and thus falls onto the chassis 10. In this solution, by providing the outer water guide groove 372 at the bottom of the pipe installation ring 370, the condensed water accumulated in the pipe installation ring 370 can be guided to the shell side plate 362 through the outer water guide groove 372 in time. The condensed water can fall along the outer surface of the shell side plate 362, and will not fall out of the chassis 10, which will not cause product quality problems, and can bring a good user experience to the user. In addition, in this embodiment, the side plate structure 360 can be a plastic plate structure.

Further, a plurality of pipe installation holes 366 and 368 may be formed at the shell side plate 362, some pipe installation holes are provided with pipe installation rings 370, and each pipe installation hole 366 and 368 is respectively provided with a connection pipe 2522. It can be seen that the pipe installation ring 370 can connect and fasten the connection pipe 2522. By disposing the pipe installation ring 370 at part of the pipe installation holes 366 or 368, only part of the connection pipe 2522 can be fixed, the other connection pipes 2522 only pass through the pipe installation holes 366 and 368 without being fixed. In this way, the installation, removing and maintenance of the connection pipe 2522 are facilitated, the operation efficiency is high, and the damage to the connection pipe 2522 can also be reduced.

Besides, the bottom surface of the outer water guide groove 372 can be recessed on the outer surface of the shell side plate 362. That is, the height of the bottom of the outer water guide groove 372 is lower than the height of the outer surface of the shell side plate 362, such that the condensed water in the pipe installation ring 370 can be easily guided from the outer water guide groove 372 to the outer surface of the shell side plate 362, so that the condensed water can flow down along the outer surface of the shell side plate 362.

In addition, the bottom surface of the outer water guide groove 372 is flush with the outer surface of the shell side plate 362. That is, the height of the bottom of the outer water guide groove 372 can be kept the same as the height of the outer surface of the shell side plate 362, such that the condensed water in the pipe installation ring 370 can also be smoothly guided from the outer water guide groove 372 to the outer surface of the shell side plate 362, so that the condensed water can flow down along the outer surface of the shell side plate 362.

In addition, the bottom surface of the outer water guide groove 360 slightly protrudes from the outer surface of the shell side plate 362. That is, the height of the bottom of the outer water guide groove 372 is slightly larger than the height of the outer surface of the shell side plate 362, such that the condensed water in the pipe installation ring 370 can also be smoothly guided from the outer water guide groove 372 to the outer surface of the shell side plate 362, so that the condensed water can flow down along the outer surface of the shell side plate 362.

Moreover, the bottom surface of the outer water guide groove 372 can be a flat surface, and the condensed water in the pipe installation ring 370 is also guided from the flat-bottomed outer water guide groove 372 to the outer surface of the shell side plate 362. Alternatively, the bottom surface of the outer water guide groove 372 may be an inclined surface, and the inclined surface is inclined from the pipe installation hole to the outside of the pipe installation ring 370. That is, the outer water guide groove 372 can be an inclined groove, and the condensed water inside the pipe installation ring 370 can flow more smoothly to the outer surface of the shell side plate 362 along the inclined groove.

Besides, the side plate structure 360 may include a side plate retaining ring 364 protruding from the periphery of the shell side plate 362. A retaining ring groove is formed around the side plate retaining ring 364, and both the connection pipe 2522 and the pipe installation ring 370 are located in the retaining ring groove. A protruding side plate retaining ring 364 is provided at the periphery of the shell side plate 362 to further protect the periphery, so as to prevent the condensed water from directly falling outside the shell side plate 362 and easily falling out of the chassis 10. Further, the bottom of the side plate retaining ring 364 can also be provided with a retaining ring opening 3642, and the retaining ring opening 3642 communicates with the retaining ring groove and the outside. A retaining ring opening 3642 is provided at the bottom of the side plate retaining ring 364 so that the condensed water on the shell side plate 362 can flow out from the retaining ring opening 3642.

Besides, the pipe installation hole can include a first pipe installation hole 366 and a second pipe installation hole 368 respectively provided the shell side plate 362, and a pipe installation ring 370 is provided at the outer side of the first pipe installation hole 366. Moreover, part of the connection pipe 2522 is installed in the first pipe installation hole 366 and clamped in the pipe installation ring 370, and part of the connection pipe 2522 is installed in the second pipe installation hole 368. That is, part of the connection pipe 2522 can be clamped by the pipe installation ring 370, and part of the connection pipe 2522 only passes through the pipe installation hole 368 and is not clamped. Moreover, the inner surface of the shell side plate 362 may be provided with an inner water guide groove 369, and the inner water guide groove 369 communicates with the first pipe installation hole 366 and the second pipe installation hole 368. Since the pipe installation ring 370 is disposed outside the first pipe installation hole 366, condensed water is easy to accumulate in the pipe installation ring 370 and the first pipe installation hole 366, the second fixing installation hole 368 does not fix the connection pipe 2522, such that there is a gap between the second fixing installation hole 368 and the connection pipe 2522, so that the condensed water can flow out from the second pipe installation hole 368 to the outer surface of the shell side plate 362. By arranging the inner water guide groove 369 on the inner sides of the first pipe installation hole 366 and the second pipe installation hole 368, the first pipe installation hole 366 and the second pipe installation hole 368 can be communicated with each other, such that the condensed water accumulated in the first pipe installation hole 366 can flow into the second pipe installation hole 368 along the inner water guide groove 369 and flow out to the outer surface of the shell side plate 362.

Besides, the bottom of each first pipe installation hole 366 is provided with the inner water guide groove 369, and the inner water guide groove 369 communicates with the adjacent first pipe installation hole 366 and the second pipe installation hole 368. That is, the condensed water accumulated in each of the first pipe installation holes 366 can be guided into the second pipe installation holes 368 through the inner water guide groove 369 for discharge. Moreover, the second pipe installation hole 368 communicated with the inner water guide groove 369 is located on the lower side of the first pipe installation hole 366, which is convenient for guiding the condensed water.

In addition, the bottom of each first pipe installation hole 366 is provided with the inner water guide groove 369, and the inner water guide groove 369 communicates with the two adjacent first pipe installation holes 366, and one of the first pipe installation holes 366 located at a position is communicated with another adjacent second pipe installation hole 368 located at a lower position through the inner water guide groove 369. That is, two adjacent first pipe installation holes 366 can be communicated through one inner water guide groove 369, and another second pipe installation hole 368 can be communicated through another inner water guide groove 369, which is convenient to lead out the condensed water in the two adjacent first pipe installation holes 366.

Besides, in this embodiment, the indoor heat exchanger 300 may include a heat exchanger body 310 and a heat exchanger sub-section 320 disposed at the top of the heat exchanger body 310. The shell side plate 362 may include a side plate main plate corresponding to the heat exchanger body 310 and a side plate sub-plate corresponding to the heat exchanger sub-section 320. Moreover, the inner surface of the side plate sub-plate 362 is provided with an inner water guide groove 369, and the inner water guide groove 369 communicates with the bottom of the first pipe installation hole 366 on the side plate sub-plate 362. That is, in this embodiment, the inner water guide groove 369 is only provided at the bottom of the first pipe installation hole 366 on the side plate portion of the shell corresponding to the heat exchanger sub-section 320 at the top of the indoor heat exchanger 300, to export the condensed water on the top shell side plate 362. Because the top heat exchanger sub-section 320 and the side plate sub-plate 362 are closest to the edge of the indoor water pan 100, the condensed water is more likely to fall out of the chassis, which is more necessary to guide the condensed water on the heat exchanger sub-section 320 and the side plate sub-plate 362. Moreover, in this embodiment, the heat exchanger body 310 can be inclined to be installed at the inclined support frame 200. Also, the heat exchanger sub-section 320 may be vertically disposed on the top of the heat exchanger body 310.

In addition, the inner side of the pipe installation ring 370 can be provided with a clamping plate 380, and the clamping plate 380 can be used to fasten the connection pipe 2522. When the connection pipe 2522 is to be inserted into the pipe installation ring 370, the connection pipe 2522 can be further clamped by the clamping plate 380. Further, a side edge of the pipe installation hole 366 may be provided with a clamp groove, and the clamping plate 380 protrudes from the clamp groove. That is, the clamping plate 380 can be set as a cantilever structure, which has good elasticity and can hold the connection pipe 2522 more tightly and reliably.

The above only takes the side plate structure provided at the indoor heat exchanger 300 as an example for description. However, those skilled in the art can refer to the above disclosure and set the side plate structure on the outdoor heat exchanger 38 in the same or similar manner.

Figure 13:
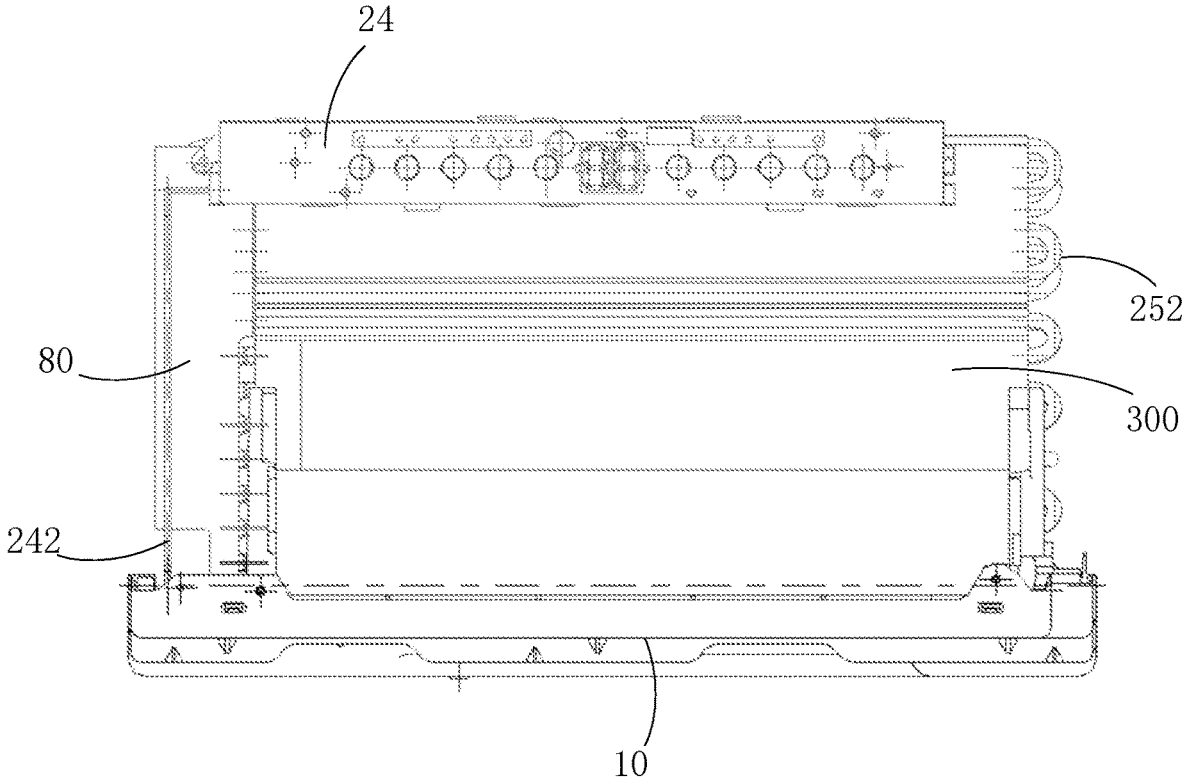
FIG. 13 is a schematic structural front view of an indoor heat exchanger, a display box and a water baffle structure arranged at the chassis of the window air conditioner according to some embodiments of the present disclosure.
Figure 14:
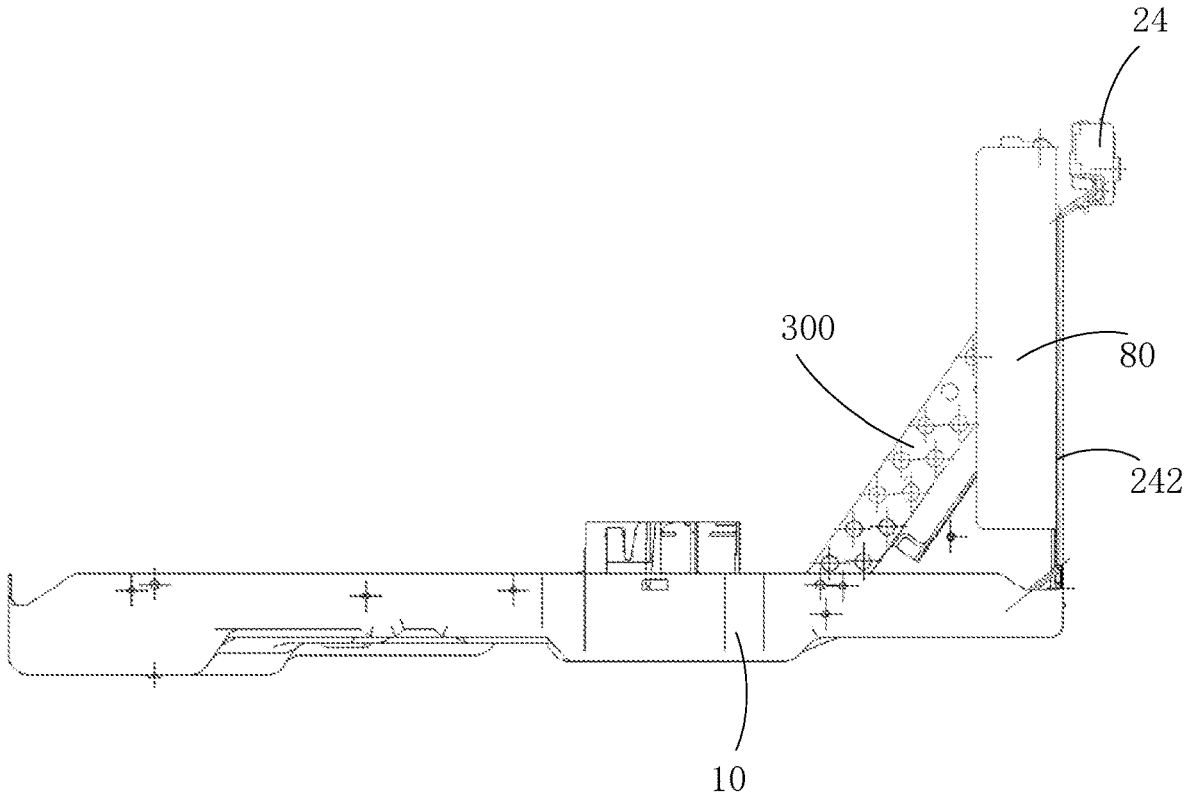
FIG. 14 is a schematic structural side view of the indoor heat exchanger, the display box and the water baffle structure arranged at the chassis of the window air conditioner according to some embodiments of the present disclosure.
Figure 15:
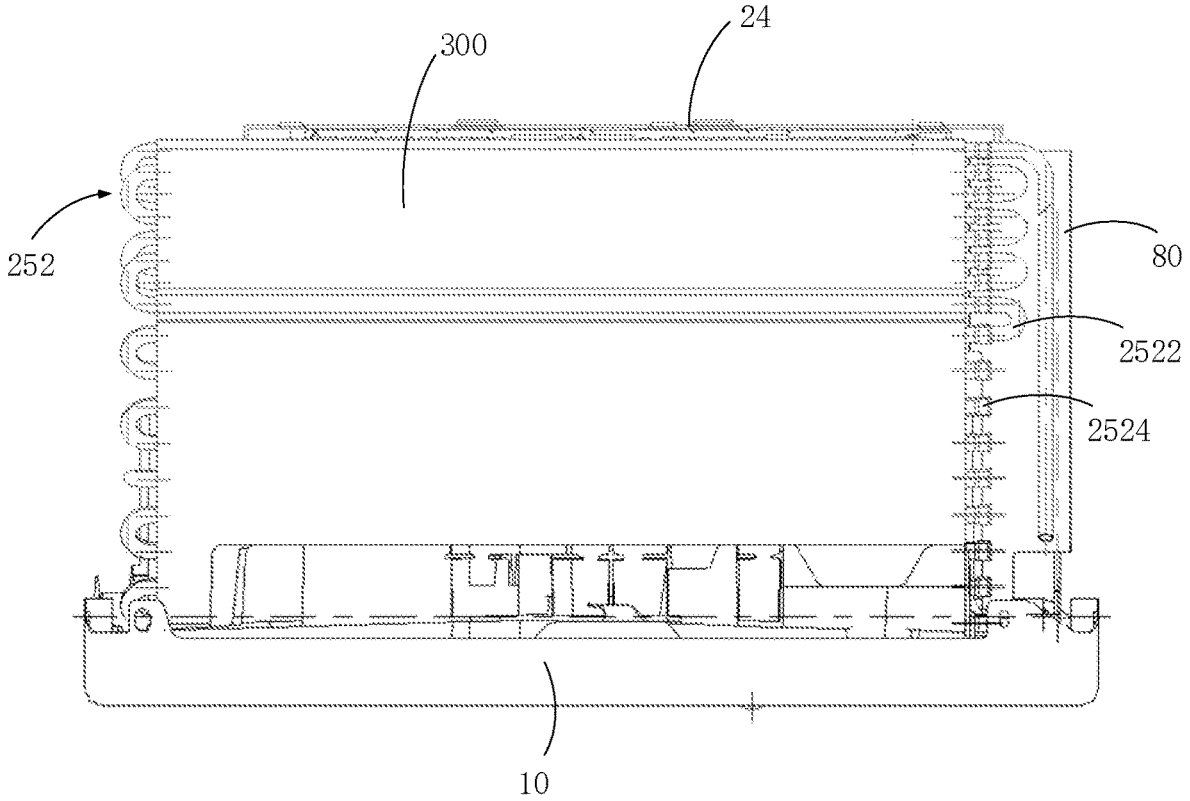
FIG. 15 is a schematic structural rear view of the indoor heat exchanger, the display box and the water baffle structure arranged at the chassis of the window air conditioner according to some embodiments of the present disclosure.
Figure 16:
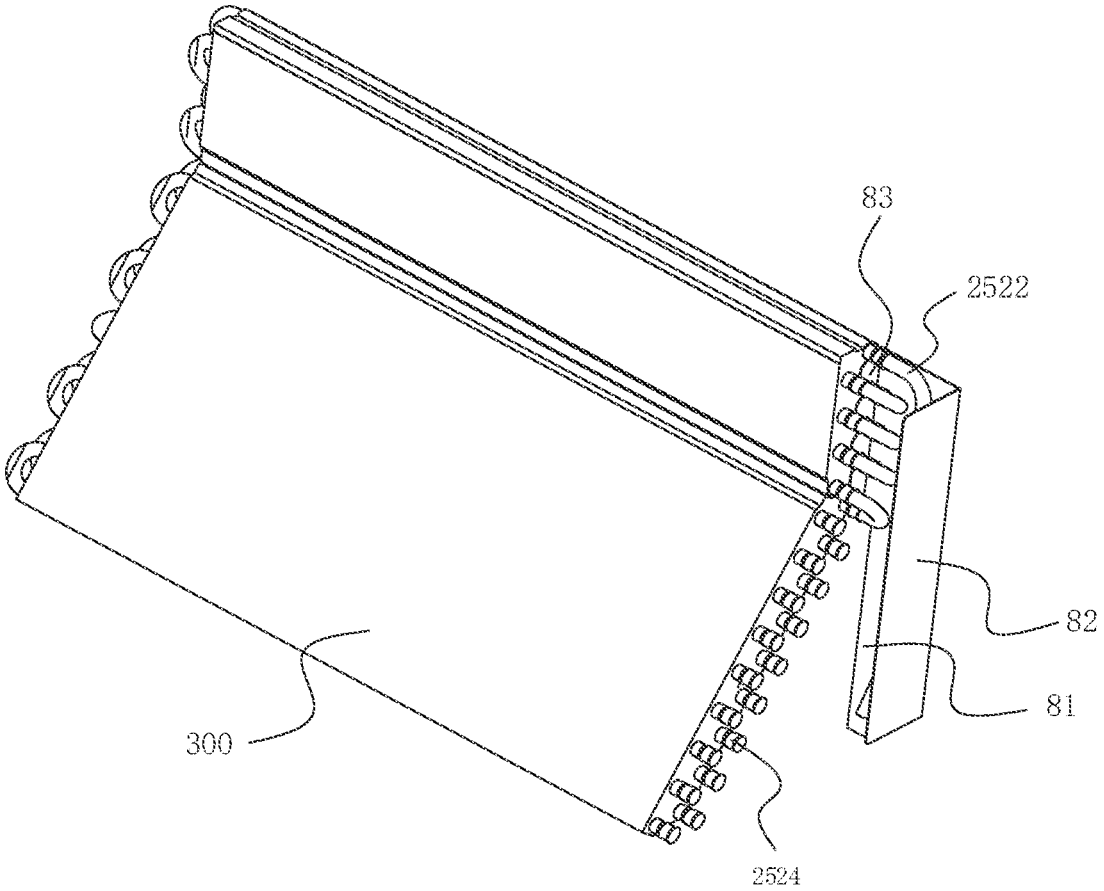
FIG. 16 is a schematic three-dimensional structural view of the window air conditioner provided with the indoor heat exchanger and the water baffle structure according to some embodiments of the present disclosure.
Figure 17:
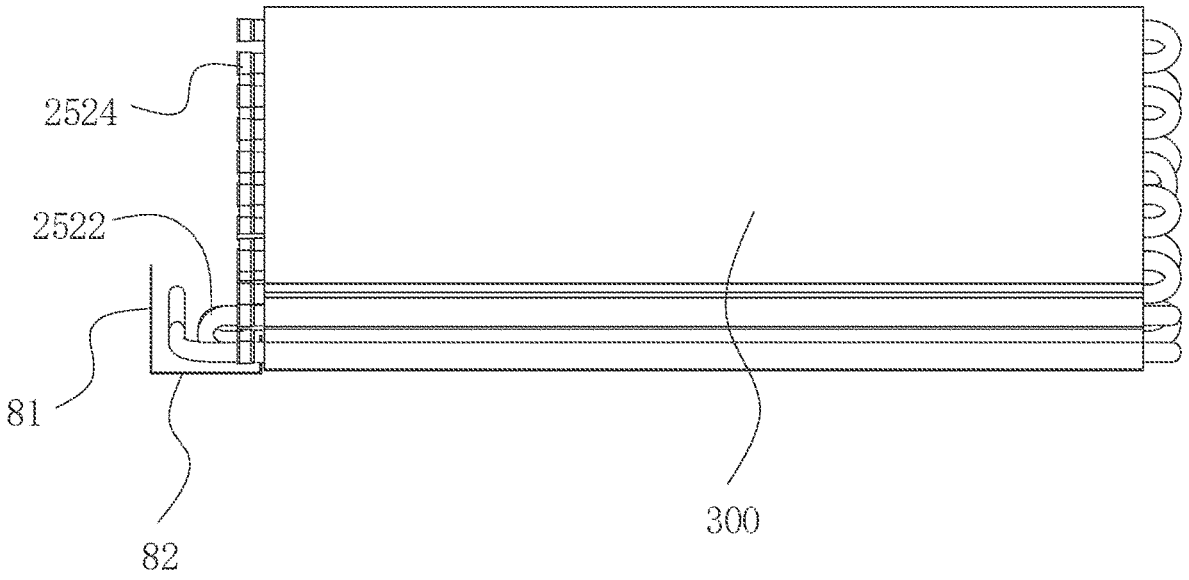
FIG. 17 is a schematic structural top view of FIG. 16.
Figure 18:
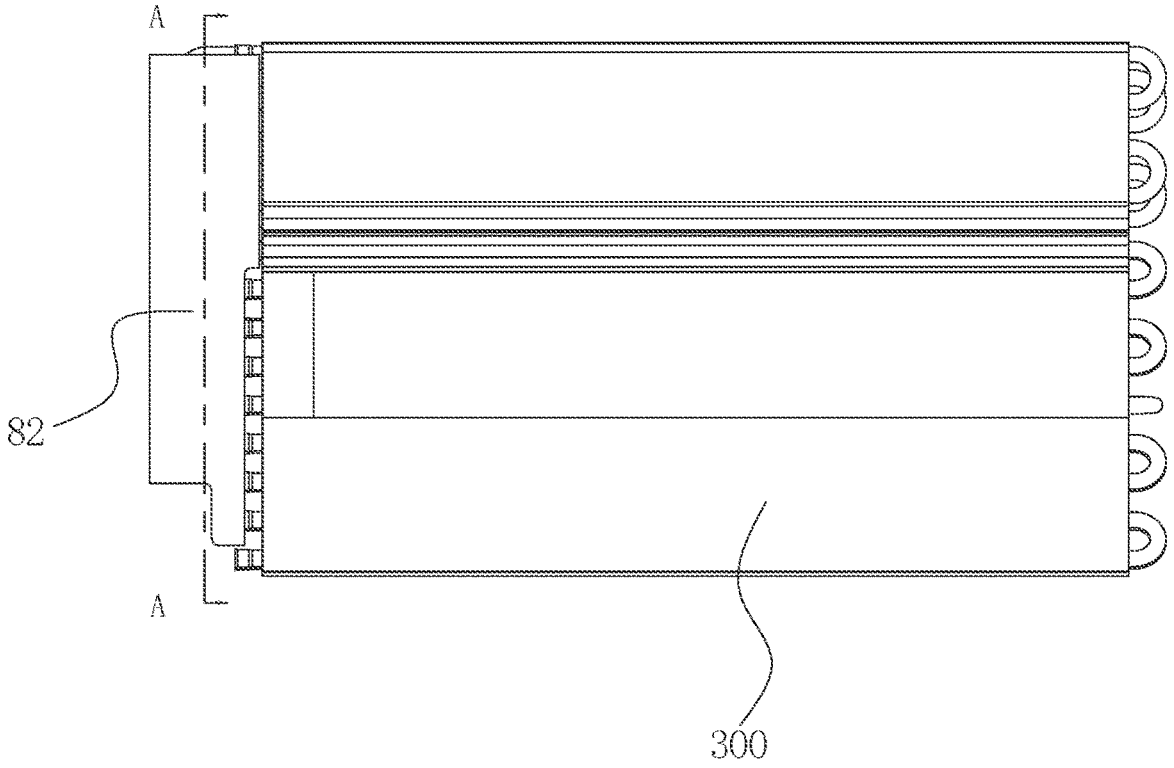
FIG. 18 is a schematic structural rear view of FIG. 16.
Figure 19:
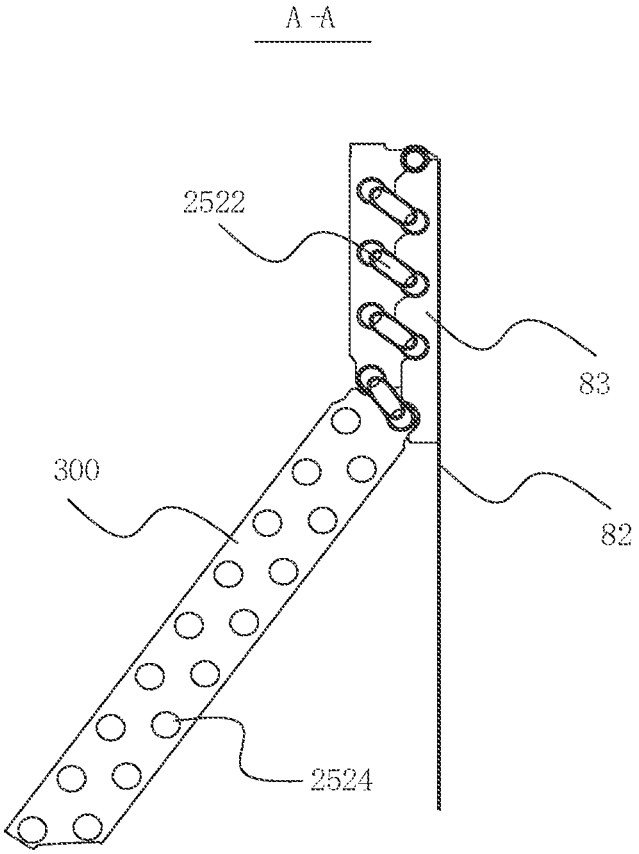
FIG. 19 is a schematic cross-sectional structural view of the section A-A of FIG. 18.

As shown in FIG. 13 to FIG. 15, the indoor heat exchanger 300 is installed at the chassis 10, an end of the indoor heat exchanger 300 has a pipe member 252, and the pipe member 252 can be configured for circulating and communicating with the indoor heat exchanger 300. The electric control box 32 can be installed in the outer casing 30 of the outer housing and provided at the chassis 10. The display box 24 can be installed at the indoor casing 20 of the outer housing, and can display the operating state of the air conditioner. Moreover, the display box 24 can be electrically connected to the electric control box 32 through the connection wire 242, so that the display box 24 can be controlled through the electric control box 32. However, the inventor found in the actual research that in the related art, the connection wires of the electrical components such as the electric control box and the display box in the window air conditioner are easy to contact with the heat exchanger. When the heat exchanger is in contact with the connection wire, the condensed water on the heat exchanger will corrode the connection wire, posing a safety hazard and causing a poor user experience. Therefore, in the embodiment of the present disclosure, a water baffle structure 80 is provided between the pipe member 252 at the end of the indoor heat exchanger 300 and the connection wire 242 of the display box 24 to isolate the pipe member 252 and the connection wire 242. A water baffle structure 80 is provided between the display box 24 and the indoor heat exchanger 300 to isolate the connection wire 242 connecting the display box 24 and the electric control box 32 from the pipe member 252 at the end of the indoor heat exchanger 300. The indoor heat exchanger 300 generates cold energy and condensed water on the pipe members 252 during the working process, the cold energy and condensed water will not be transmitted to the connection wires 242, so that the condensed water will be generated on the connection wires 242, and then the condensed water will be guided into the display box 24 to threaten the safety of the display box 24. In this way, the connection wire 242 connecting the display box 24 and the indoor heat exchanger 300 and its pipe members 252 are isolated by the water baffle structure 80, so that the use safety of the display box 24 can be ensured.

As shown in FIG. 16 to FIG. 19, the water baffle structure 80 may include a water-blocking main plate 81 extending along the bottom of the indoor heat exchanger 300 to the top of the indoor heat exchanger 300. The pipe member 252 at the end of the indoor heat exchanger 300 and the connection wire 242 are separated on both sides of the water-blocking main plate 81. That is, the water baffle structure 80 can be arranged along the extending direction of the indoor heat exchanger 300, so that the pipe member 252 at the end of the indoor heat exchanger 300 can be completely isolated from the connection wires 242 of the display box 24, and the isolation effect is good.

Besides, the water baffle structure 80 further includes a water-blocking connection member 83 provided at the water-blocking main plate 81, and the water-blocking connection member 83 is detachably connected to the indoor heat exchanger 300 or the pipe member 252. That is, the water-blocking connection member 83 can be provided at the water baffle structure 80 to connect the water baffle structure 80 with the indoor heat exchanger 300 or its pipe members 252. The water baffle structure 80 can stably and reliably isolate the connection wires 242 of the display box 24. In addition, the water-blocking connection member 83 can also be connected to the chassis 10, or to the casing, or to the indoor air duct shell 60. Moreover, in this embodiment, the water-blocking connection member 83 can be connected to the indoor heat exchanger 300 or its piping member 252, which is convenient for connection at short distances.

In addition, the pipe member 252 may include a refrigerant pipe 2524 protruding from the end of the indoor heat exchanger 300, and a connection pipe 2522 connecting the two refrigerant pipes 2524. That is, the water-blocking connection member 83 of the water baffle structure 80 can be connected to the refrigerant pipe 2524, the connection pipe 2522, or both the refrigerant pipe 2524 and the connection pipe 2522.

Further, in some embodiments, the water-blocking connection member 83 may include a screw connection seat provided at the water-blocking main plate 81, and the screw connection seat is connected to the indoor heat exchanger 300 through a screw connection. That is, the water baffle structure 80 can be connected to the indoor heat exchanger 300 by means of the screw connection, the connection is simple and convenient, and the connection is stable and reliable.

Besides, in another embodiment, the water-blocking connection member 83 may include a snap connection structure disposed on the water-blocking main plate 81, and the snap connection structure may be snap connected to the indoor heat exchanger 300 or the pipe member 252. That is, the indoor heat exchanger 300 and the water baffle structure 80 can be connected through the snap connection structure, or the pipe member 252 and the water baffle structure 80 can be connected through the snap connection structure, and the connection is also simple, convenient, stable and reliable.

Further, the snap connection structure can include a clamping plate with a plurality of clamp grooves provided at the water-blocking main plate 81, and the pipe member 252 at the end of the indoor heat exchanger 300 is clamped in the clamp grooves of the clamping plate. That is, a clamp groove can be provided at the water baffle structure 80 to clamp the pipe member 252, so as to realize the snap connection between the pipe member 252 and the water baffle structure 80. Moreover, in this embodiment, the plurality of clamp grooves on the clamping plate can be in a wave shape, and the plurality of pipe members 252 are clamped in the plurality of clamp grooves in a one-to-one correspondence. That is, the water baffle structure 80 can be clamped on the plurality of pipe members 252 at the same time, and the connection is more stable and reliable. In addition, in addition to clamping the water baffle structure 80 on the pipe member 252, it can also be directly clamped on the indoor heat exchanger 300.

In addition, the snap connection structure may further include a snap ring provided at the indoor heat exchanger 300 or the pipe member 252, and a snap protrusion provided at the water-blocking main plate 81. The snap protrusion can be snap-connected to the snap ring, so as to snap-connect the indoor heat exchanger 300 (or the pipe member 252) and the water baffle structure 80 together.

Beside, in another embodiment, it is also possible to make the water-blocking connection member 83 include the screw connection structure and snap connection structure at the same time, and simultaneously perform screw connection and snap connection between the water baffle structure 80 and the indoor heat exchanger 300.

The water baffle structure 80 may include a water-blocking side plate 82 bent and disposed on at least one side of the water-blocking main plate 81. The water-blocking side plate 82 and the water-blocking main plate 81 are surrounded to form a water-blocking groove, and the pipe members 252 are all located in the water-blocking groove. Water-blocking side plates 82 can be provided at one side or both sides of the water-blocking main plate 81. The water-blocking side plate 82 is bent and extended from the edge of the water-blocking main plate 81 toward the indoor heat exchanger 300 to surround the pipe member 252. The indoor heat exchanger 300 and the pipe member 252 can be partitioned from the front and side at the same time, and the pipe member 252 can be completely isolated. Further, the water baffle structure 80 may include a water-blocking side plate 82 bent on one side of the water-blocking main plate 81, and the water-blocking side plate 82 is connected to the water-blocking main plate 81 to form an L-shaped enclosure structure. In this embodiment, a bent water-blocking side plate 82 can be provided only at one side of the water-blocking main plate 81 to isolate the pipe member 252 from one side. Moreover, the water-blocking side plate 82 on this side is relatively close to the connection wire 242 of the display box 24. Moreover, in this embodiment, the water-blocking side plate 82 and the water-blocking main plate 81 may be perpendicular to each other.

The pipe members 252 may be spaced apart on the inner side of the water baffle structure 80, and the connection wires 242 of the display box 24 may be spaced apart or attached to the outer side of the water baffle structure 80. There can be a gap between the pipe member 252 of the indoor heat exchanger 300 and the water baffle structure 80, so that the cooling capacity will not be directly transferred from the pipe member 252 to the water baffle structure 80 and condensed water will not be generated on the water baffle structure 80. Moreover, a gap can be formed between the connection wire 242 of the display box 24 and the water baffle structure 80, and condensed water is not easily generated on the connection wire 242. The connection wire 242 can also be provided at the water baffle structure 80 to facilitate the fixing of the connection wire 242 to the connection wire.

The water baffle structure 80 may be a plastic board. The plastic board has better thermal insulation effect and is not easy to produce condensed water. Moreover, in this embodiment, the water baffle structure 80 can be a transparent polyvinyl chloride plate, so that the condition of the indoor heat exchanger inside can be observed through the water baffle structure 80.

Figure 21:
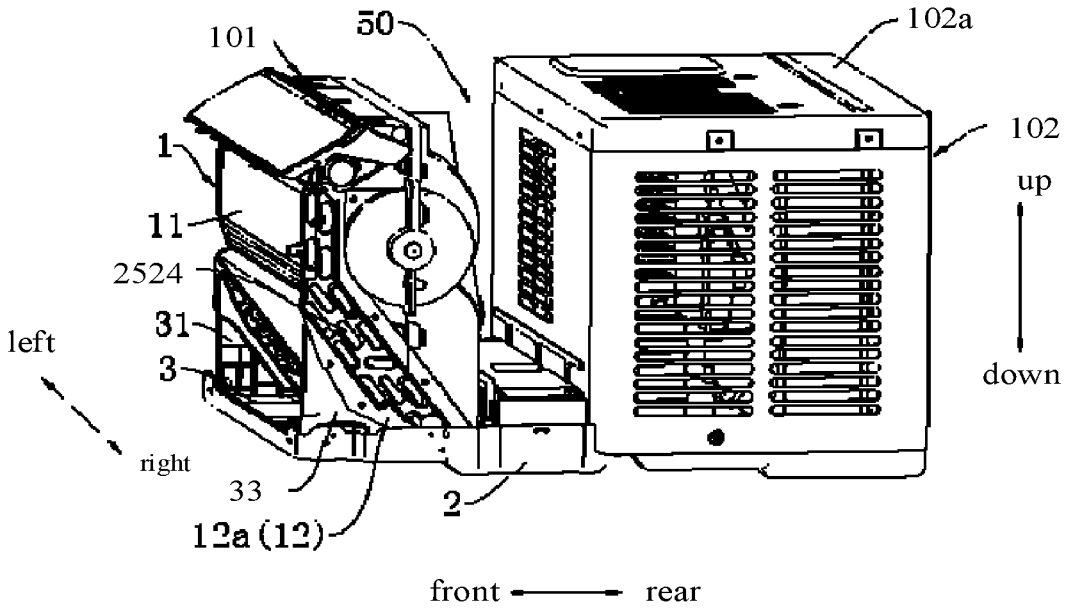
FIG. 21 is a partial schematic structural view of the window air conditioner according to another embodiments of the present disclosure.
Figure 22:
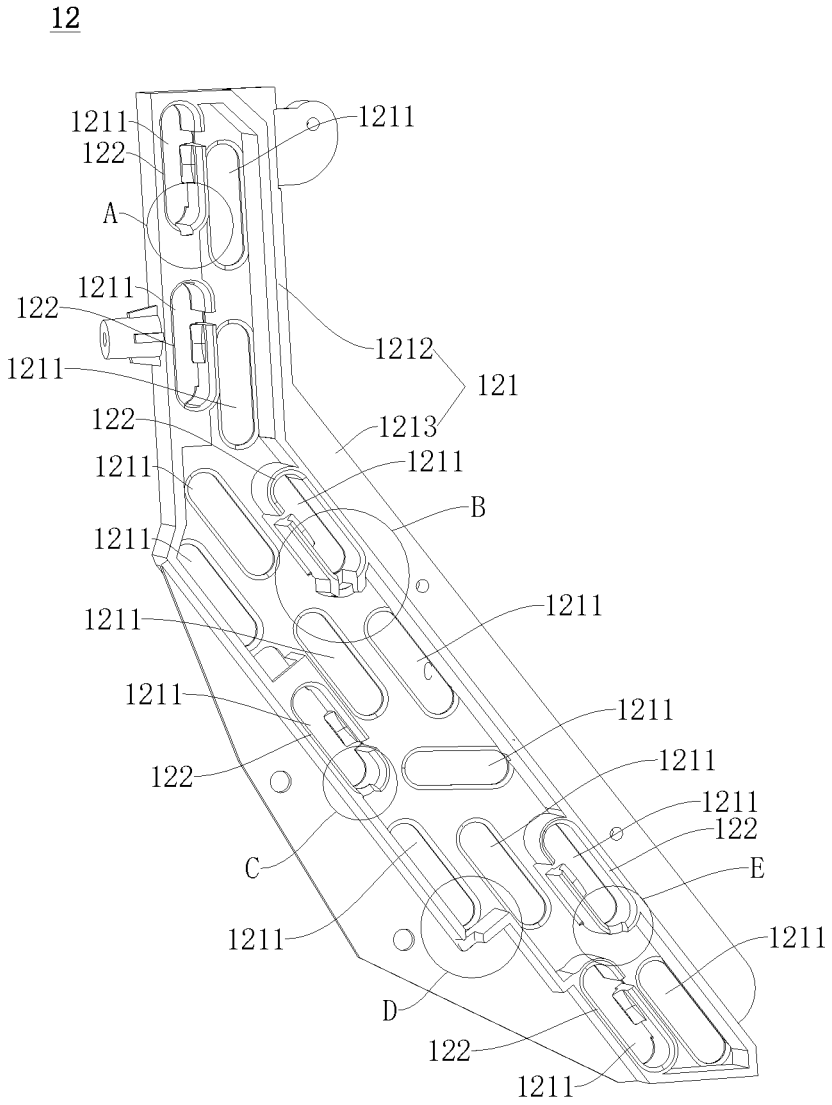
FIG. 22 is a structural view of the side plate structure according to some embodiments of the present disclosure.
Figure 23:
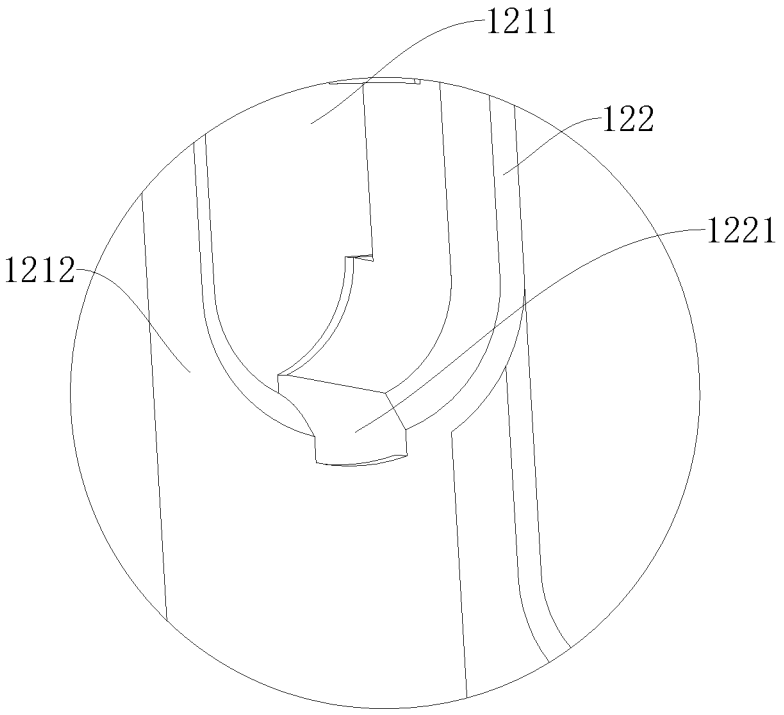
FIG. 23 is an enlarged view of portion A in FIG. 22.
Figure 24:
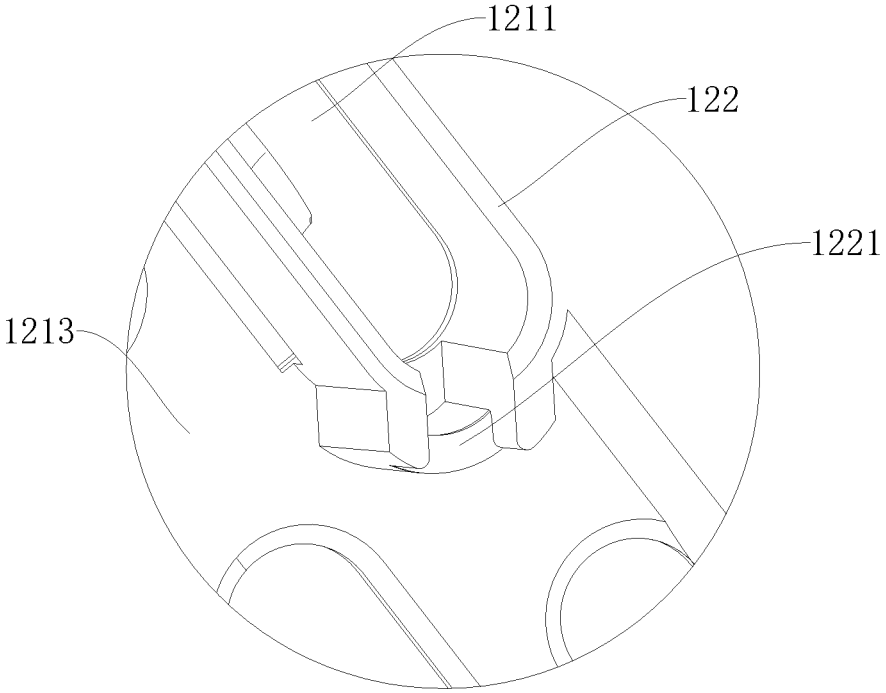
FIG. 24 is an enlarged view of portion B in FIG. 22.
Figure 25:
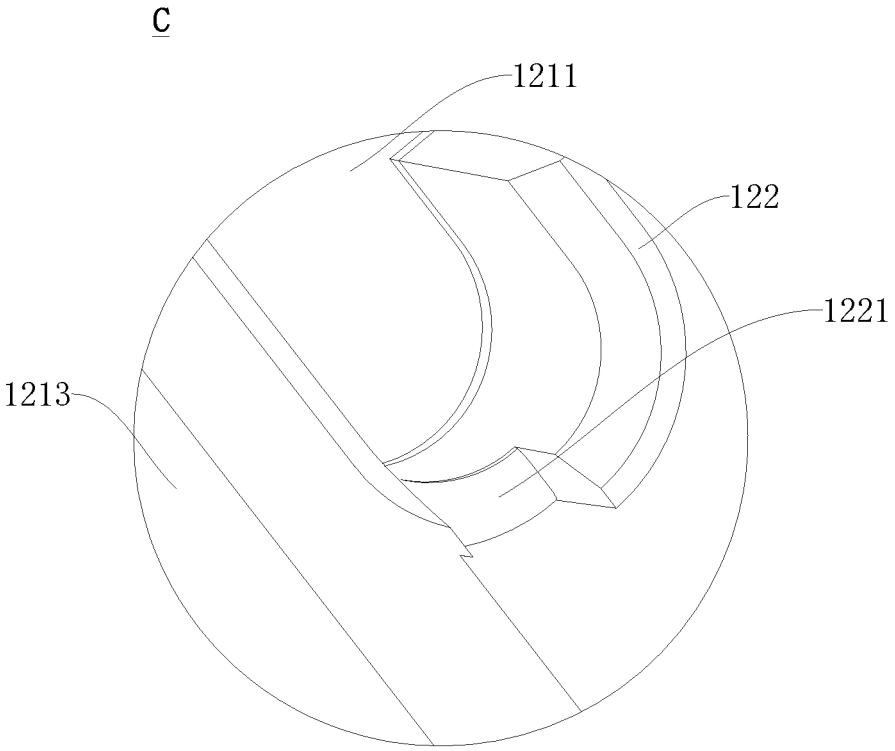
FIG. 25 is an enlarged view of portion C in FIG. 22.
Figure 26:
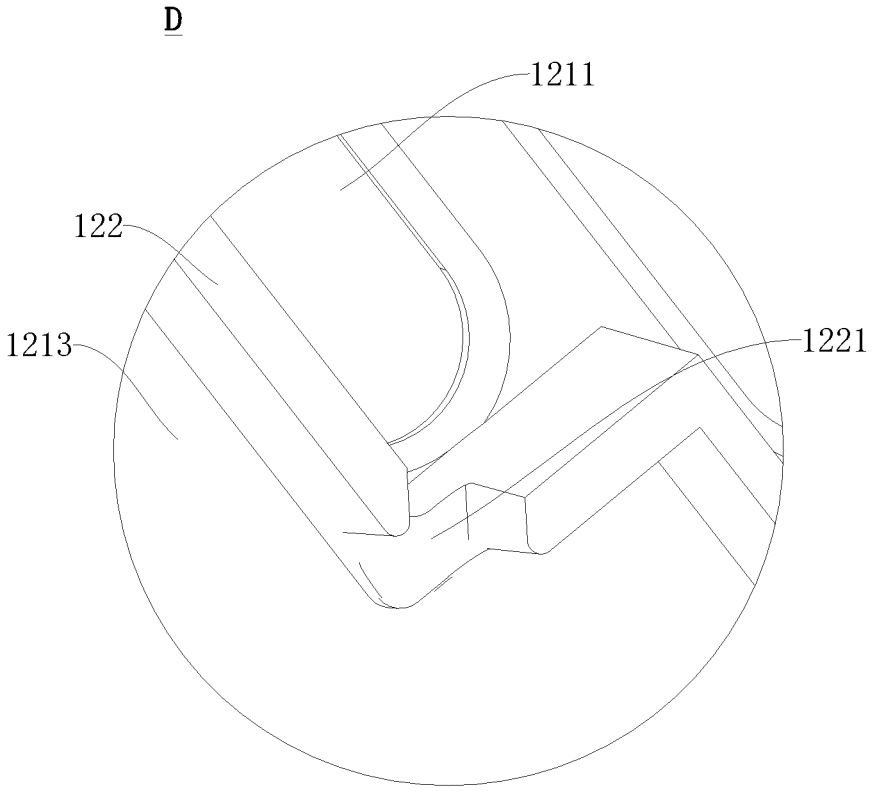
FIG. 26 is an enlarged view of portion D in FIG. 22.
Figure 27:
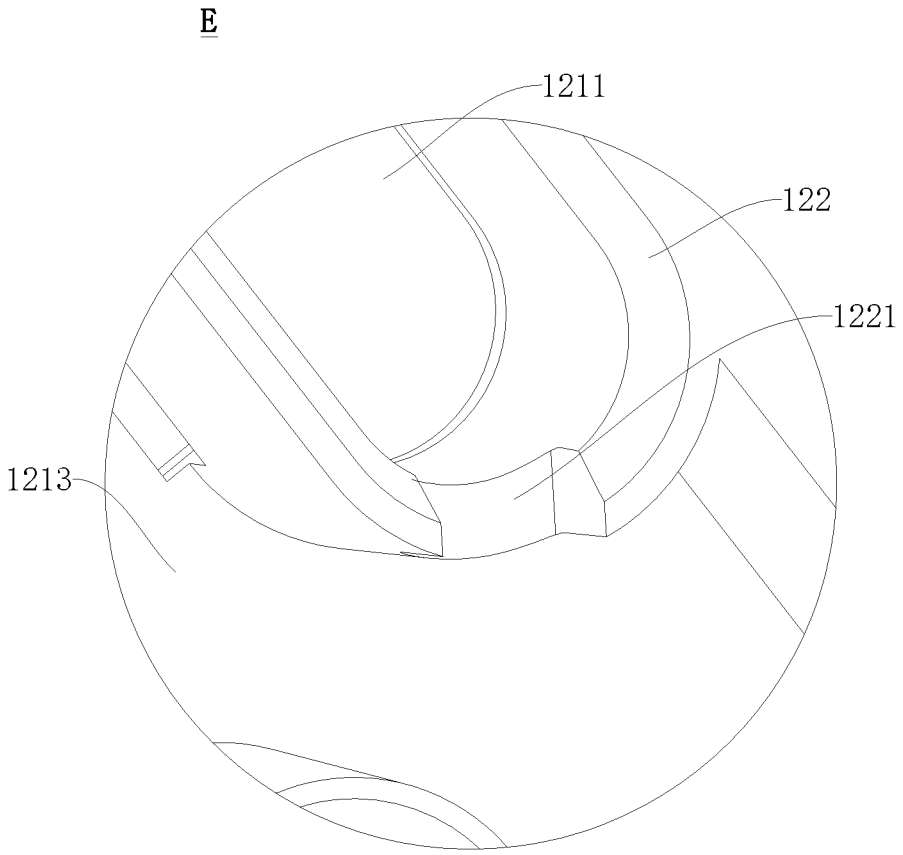
FIG. 27 is an enlarged view of portion E in FIG. 22.

As shown in FIG. 21 and FIG. 22, which shows an indoor heat exchanger 1 of the window air conditioner according to some embodiments of the present disclosure. The indoor heat exchanger 1 includes a heat exchanger body 11 and a side plate structure 12 provided at the heat exchanger body 11. The heat exchanger body 11 includes a refrigerant pipe 2524 and a plurality of fins provided at the refrigerant pipe 2524 spaced apart. The side plate structure 12 can fix the indoor heat exchanger 1 in the whole machine, and the side plate structure 12 includes the side plate body 121. The side plate body 121 is formed with matching holes 1211 for matching the refrigerant pipes 2524 of the indoor heat exchanger 1, and the refrigerant pipe 2524 can pass through the matching hole 1211. A protective protrusion 122 is formed at the periphery of each of at least some of the matching holes 1211, and the protective protrusion 122 is located on the side of the side plate body 121 away from the heat exchanger body 11. The protective protrusion 122 extends along the circumferential direction of the matching hole 1211. For example, some of the matching holes 1211 have the protective protrusion 122 formed at the periphery thereof, or, all of the matching holes 1211 have the protective protrusion 122 formed at the periphery thereof. The protective protrusion 122 can protect the refrigerant pipe 2524 protruding from the side plate.

When the indoor heat exchanger 1 is used as an evaporator, for example, when the indoor heat exchanger 1 is applied to an air conditioner, condensed water will form on the refrigerant pipe 2524 when the air conditioner is working. Since the refrigerant pipe 2524 is inserted into the matching hole 1211, the condensed water on the refrigerant pipe 2524 will flow to the side plate structure 12, and the condensed water will flow along the side plate structure 12 by gravity. The air conditioner is provided with a water pan 3 to collect the condensed water on the refrigerant pipe 2524 and the side plate structure 12. The water pan 3 is directly below the heat exchanger body 11. However, sometimes limited by the structure of the side plate structure 12 and the structure of the water pan 3, the condensed water on the part where the refrigerant pipe 2524 matches the side plate structure 12 will flow out of the water pan 3 along the side plate structure 12 and drip onto the indoor floor.

A water leakage hole 1221 is formed at the protective protrusion 122. Since the refrigerant pipe 2524 penetrates the matching hole 1211, and the periphery of at least a part of the matching holes 1211 is formed with a protective protrusion 122, the condensed water formed by the part of the refrigerant pipe 2524 that matches the side plate structure 12 can be accumulated in the protective protrusion 122, and the condensed water can flow along the inner wall of the protective protrusion 122 to the water leakage hole 1221. When the liquid level of the condensed water is higher than the water leakage hole 1221, the condensed water will drop directly from the water leakage hole 1221 to the water pan 3 by gravity, and will not flow out of the water pan 3 along the side plate structure 12. Therefore, the condensed water on the refrigerant pipe 2524 is prevented from flowing along the side plate structure 12 to other components of the air conditioner or dripping onto the indoor floor.

The side plate body 121 is formed with a matching hole 1211 for matching the refrigerant pipe 2524 of the indoor heat exchanger 1. The periphery of at least some of the matching holes 1211 is formed with a protective protrusion 122. The protective protrusion 122 can protect the refrigerant pipe 2524, and a water leakage hole 1221 is formed at the protective protrusion 122. When the indoor heat exchanger 1 is used as an evaporator, the condensed water formed at the part of the refrigerant pipe 2524 that matches the side plate structure 12 can flow to the water leakage hole 1221 along the protective protrusion 122, and then drip directly from the water leakage hole 1221 to the water pan 3 of the air conditioner. Therefore, the condensed water formed at the refrigerant pipe 2524 can be prevented from flowing along the side plate structure 12 to other components of the air conditioner or dripping onto the indoor floor, which improves the safety of the whole machine and reduces the inconvenience to users.

As shown in FIG. 22 to FIG. 27, according to some embodiments of the present disclosure, a water leakage hole 1221 is formed at the lowest position of the protective protrusion 122, such that the condensed water flowing on the inner wall of the protective protrusion 122 drips directly from the water leakage hole 1221. Thus, the condensed water in the protective protrusion 122 is prevented from overflowing to the side plate body 121, and the condensed water is prevented from flowing along the side plate structure 12 to the indoor floor. At the same time, this design can prevent excessive condensed water from accumulating in the protective protrusion 122, and the condensed water on the refrigerant pipe 2524 will drip directly from the water leakage hole 1221 due to gravity.

As shown in FIG. 22 to FIG. 27, a part of the protective protrusion 122 is located at the lowest position of the matching hole 1211, and this design makes a protective protrusion 122 be provided at the lowest position of the matching hole 1211, and this part of the protective protrusion 122 is also the lowest position of the entire protective protrusion 122, so that it is convenient to form a water leakage hole 1221 at the lowest position of the protective protrusion 122, such that the condensed water flowing on the inner wall of the protective protrusion 122 drips directly from the water leakage hole 1221. Thus, the condensed water in the protective protrusion 122 is prevented from overflowing to the side plate body 121, and the condensed water is prevented from flowing to the indoor floor along the side plate structure 12, and it is also beneficial to avoid excessive accumulation of condensed water in the protective protrusion 122.

As shown in FIG. 22 to FIG. 27, according to some embodiments of the present disclosure, the water leakage hole 1221 is a notch formed at the protective protrusion 122, and the notch can lead the condensed water in the protective protrusion 122 to a position away from the side plate body 121, such that the condensed water dripping from the water leakage hole 1221 is prevented from falling onto the side plate body 121, and this design facilitates the formation of the water leakage hole 1221. The water leakage holes 1221 can be formed by injection molding of the protective protrusions 122, and the water leakage holes 1221 can also be formed by processing the complete protective protrusions 122.

As shown in FIG. 22, according to some embodiments of the present disclosure, the side plate structure 12 is an integral molded part. This design enables the side plate body 121 and the protective protrusion 122 to have high connection strength, prevents the protective protrusion 122 from falling off, and simplifies the processing and molding process of the side plate structure 12.

As shown in FIG. 22, according to some embodiments of the present disclosure, the side plate body 121 includes a first sub-side plate body 1212 and a second sub-side plate body 1213 which are connected up and down. An angle is formed between the first sub-side plate body 1212 and the second sub-side plate body 1213. Compared with the side plate body extending in the vertical direction, the overall length of the side plate body 121 is increased due to the angle between the first sub-side plate body 1212 and the second sub-side plate body 1213. Therefore, the heat exchanger body 11 can be made larger, the heat exchange efficiency of the indoor heat exchanger 1 can be improved, and the heat exchange can be uniform. When the indoor heat exchanger 1 is applied to the air conditioner, the space utilization rate inside the air conditioner can also be improved, and the size of the whole machine can be reduced.

As shown in FIG. 22, the second sub-side plate body 1213 is connected below the first sub-side plate body 1212. The first sub-side plate body 1212 extends in the vertical direction, and the angle between the first sub-side plate body 1212 and the second sub-side plate body 1213 ranges from 30° to 50°. This design can not only improve the space occupancy rate of the indoor heat exchanger 1 and reduce the size of the whole machine. Moreover, the airflow streamline at the indoor heat exchanger 1 is smoother than other shapes, with less airflow noise, less air pressure and air volume loss. The indoor heat exchanger 1 has high energy efficiency, and while taking into account the product size, the operating noise is reduced, and the energy efficiency of the indoor heat exchanger 1 is improved.

As shown in FIG. 21 and FIG. 22, in another embodiment, the indoor heat exchanger 1 includes a heat exchanger body 11, a first side plate and a second side plate 12*a*. The first side plate and the second side plate 12*a* are respectively disposed on the left and right sides of the heat exchanger body 11. At least one of the first side plate and the second side plate 12*a* is the side plate structure 12 according to the foregoing embodiments of the present disclosure. For example, the first side plate is the side plate structure 12 according to the foregoing embodiments of the present disclosure; or, the second side plate 12*a* is the side plate structure 12 according to the foregoing embodiments of the present disclosure. The first side plate is the side plate structure 12 according to the foregoing embodiment of the present disclosure, and the second side plate 12*a* is the side plate structure 12 according to the foregoing embodiment of the present disclosure. By arranging the side plate structure 12 according to the foregoing embodiment of the present disclosure, when the indoor heat exchanger 1 is applied to an air conditioner, the condensed water formed at the refrigerant pipe 2524 can drip from the water leakage hole 1221 to the water pan 3 of the air conditioner, thereby preventing the condensed water formed at the refrigerant pipe 2524 from flowing along the side plate and dripping into the room.

In the indoor heat exchanger 1 of the present disclosure, by arranging the side plate structure 12 of the indoor heat exchanger 1, when the indoor heat exchanger 1 is applied to the air conditioner, the condensed water formed at the refrigerant pipe 2524 can directly drip onto the water pan 3 of the air conditioner, thereby preventing the condensed water formed at the refrigerant pipe 2524 from flowing along the side plate structure 12 and dripping into the room.

As shown in FIG. 21, according to some embodiments of the present disclosure, the first side plate is a metal part, and the second side plate 12*a* is a plastic part. This design facilitates the assembly and molding of the indoor heat exchanger 1. When the indoor heat exchanger 1 is applied to the air conditioner, it is convenient to match the indoor heat exchanger 1 with the water pan 3 of the air conditioner, to simplify the assembly process of the indoor heat exchanger 1 and to improve the assembly efficiency of the indoor heat exchanger 1. The second side plate 12*a* is the side plate 12 according to some embodiments of the present disclosure, which can prevent the condensed water on the second side plate 12*a* from dripping into the room.

Figure 20:
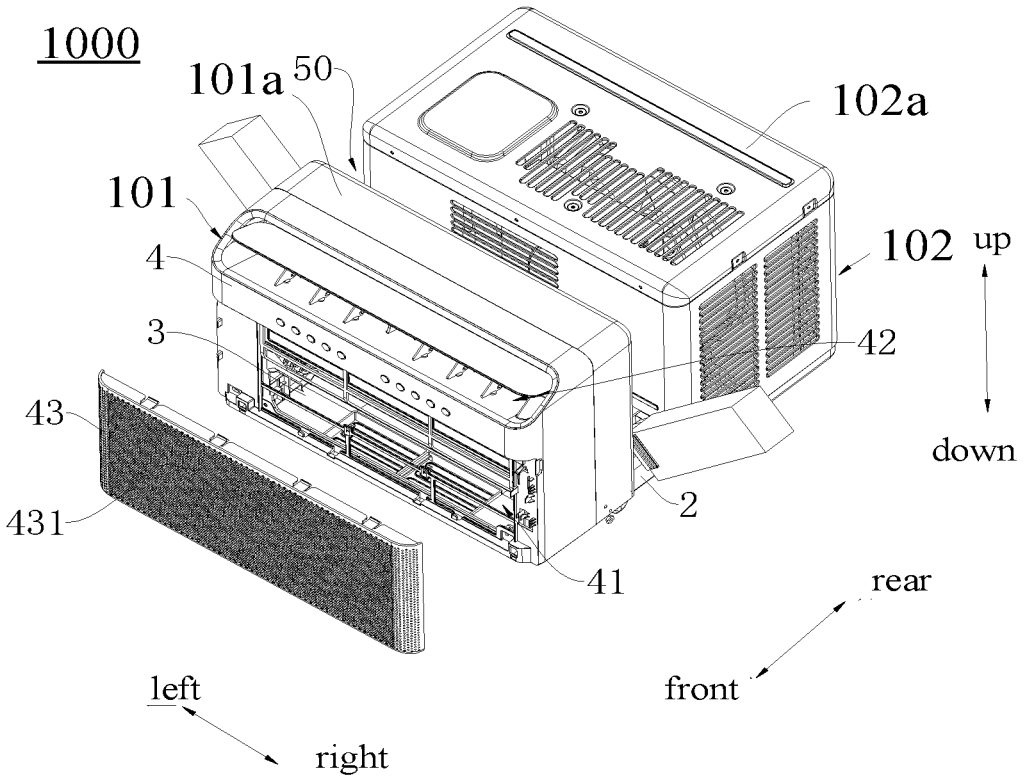
FIG. 20 is an exploded view of the window air conditioner according to another embodiments of the present disclosure.

As shown in FIG. 20, which shows a window air conditioner 1000 according to some embodiments of the present disclosure. The window air conditioner 1000 includes a chassis 2, a water pan 3 and an indoor heat exchanger 1. The water pan 3 is provided at the chassis 2. The indoor heat exchanger 1 is provided at the water pan 3, and a part of the projection of at least one of the first side plate and the second side plate 12*a* on the horizontal plane is located outside the projection of the water pan 3 on the horizontal plane. For example, a part of the projection of the first side plate on the horizontal plane is located outside the projection of the water pan 3 on the horizontal plane. By setting the first side plate to be the side plate structure 12 according to the foregoing embodiments of the present disclosure, the condensed water on the first side plate can be prevented from flowing out of the water pan 3. Alternatively, a part of the projection of the second side plate 12*a* on the horizontal plane is located outside the projection of the water pan 3 on the horizontal plane. By setting the second side plate 12*a* to be the side plate structure 12 according to the foregoing embodiments of the present disclosure, the condensed water on the second side plate 12*a* can be prevented from flowing out of the water pan 3. Alternatively, a part of the projection of the first side plate on the horizontal plane is located outside the projection of the water pan 3 on the horizontal plane, and a part of the projection of the second side plate 12*a* on the horizontal plane is located outside the projection of the water pan 3 on the horizontal plane. By setting the first and second side plates 12*a* to be the side plate structures 12 according to the foregoing embodiments of the present disclosure, the condensed water on the first and second side plates 12*a* can be prevented from flowing out of the water pan 3.

In the window air conditioner 1000 of the present disclosure, by arranging the above indoor heat exchanger 1, the condensed water formed at the refrigerant pipe 2524 can directly drip onto the water pan 3 of the window air conditioner 1000, therefore, the condensed water formed at the refrigerant pipe 2524 can be prevented from flowing along the side plate to other components of the window air conditioner 1000 or dripping onto the indoor floor, which improves the safety of the whole machine and reduces the inconvenience to users.

As shown in FIG. 21, according to some embodiments of the present disclosure, the left and right ends of the chassis 2 are respectively provided with a first support plate 31 and a second support plate 32. The first side plate is connected to the first support plate 31. The second side plate 12*a* is connected to the second support plate 32. The first support plate 31 and the second support plate 32 can fix the indoor heat exchanger 1 in the whole machine. An air duct is formed between the water pan 3, the first support plate 31, the second support plate 32, the indoor heat exchanger 1 and the volute of the window air conditioner 1000. By arranging the first support plate 31 and the second support plate 32, the airtightness of the air duct can be improved, and the air leakage of the air duct can be reduced.

The first support plate 31, the second support plate 32 and the water pan 3 are integrally formed, such that the connection strength of the first support plate 31, the second support plate 32 and the water pan 3 can be improved, thereby improving the overall structural stability of the window air conditioner 1000.

As shown in FIG. 20 and FIG. 21, in some embodiments of the present disclosure, the window air conditioner 1000 includes a chassis 2, an indoor portion 101 and an outdoor portion 102, and both the indoor portion 101 and the outdoor portion 102 are provided at the chassis 2. The indoor portion 101 includes an indoor housing 101*a*, an indoor heat exchanger 1, and an indoor fan, and the outdoor portion 102 includes an outdoor housing 102*a*, an outdoor heat exchanger, and an outdoor fan. The indoor housing 101*a* includes a face frame 4 and an air inlet panel 43, and the indoor sub-housing is connected to the rear side of the face frame 4. The face frame 4 and the chassis 2 form an installation cavity, and the indoor heat exchanger 1 and the indoor fan are provided in the installation cavity. The indoor fan includes an impeller and a motor, and the motor can drive the impeller to rotate. An air inlet 41 and an air outlet 42 are formed at the face frame 4, and a ventilation structure 431 communicated with the air inlet 41 is formed at the air inlet panel 43. The ventilation structure 431 may be a plurality of ventilation holes formed at the air inlet panel 43. The indoor fan can drive indoor air to enter the window air conditioner 1000 from the air inlet and exchange heat with the indoor heat exchanger 1, and the outlet air of the window air conditioner 1000 can be discharged from the air outlet 42.

As shown in FIG. 20 and FIG. 21, in some embodiments of the present disclosure, the window air conditioner 1000 is suitable for being supported on the window of the wall. There are movable shielding members in the window. The window air conditioner 1000 has a partition groove 50, and at least a part of the shielding members is adapted to protrude into the partition groove 50. This design makes the window air conditioner 1000 easy to be installed, and the movable shielding member matches the partition groove 50, so that the installation place of the window air conditioner 1000 is sealed and the window air leakage is reduced.

Figure 28:
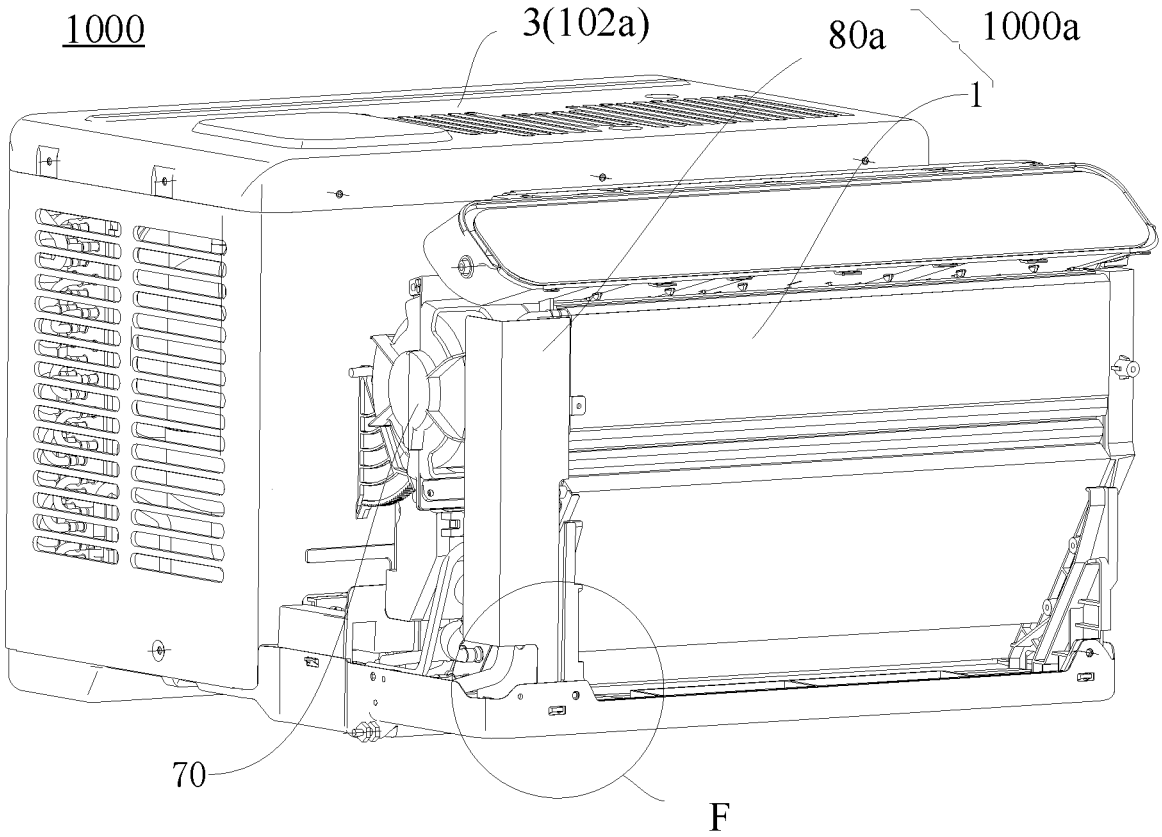
FIG. 28 is a partial schematic structural view of the window air conditioner according to still another embodiment of the present disclosure.
Figure 29:
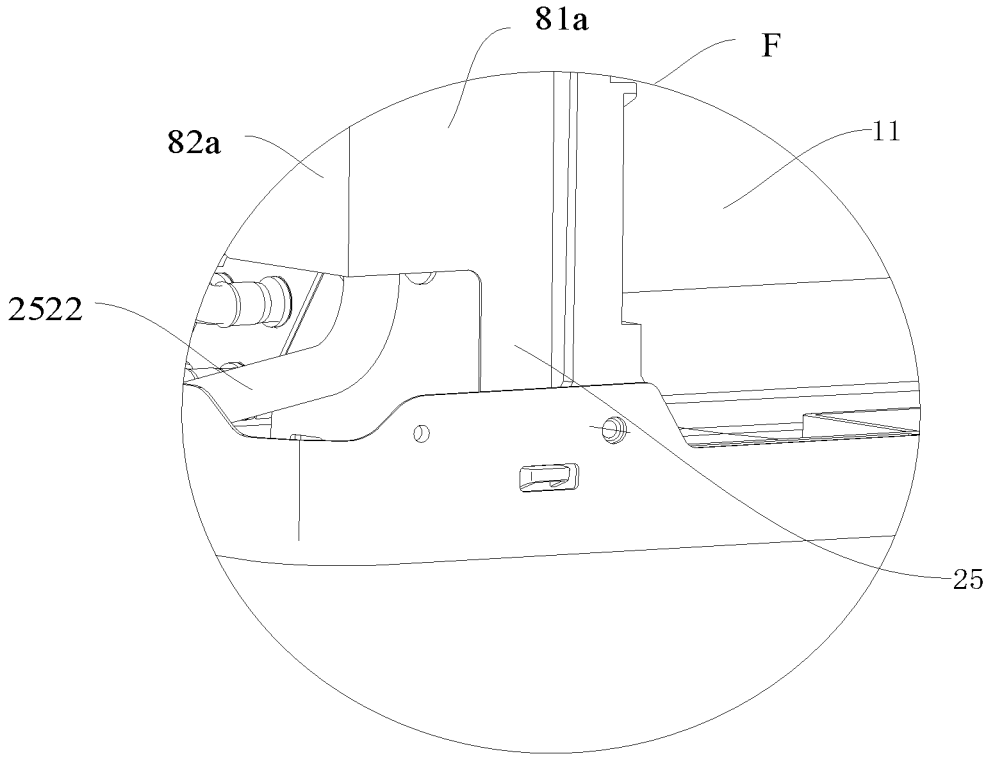
FIG. 29 is an enlarged schematic view of portion F in FIG. 28.

In yet another embodiment of the present disclosure, a window air conditioner is further provided. As shown in FIG. 28 and FIG. 29, the window air conditioner 1000 includes a heat exchanger assembly 1000*a*, the heat exchanger assembly 1000*a* includes an indoor heat exchanger 1 and a water baffle structure 80*a*, and the heat exchanger assembly 1000*a* is located in the casing 37 of the window air conditioner 1000. The water baffle structure 80*a* shields the connecting member 2522 (i.e., the pipeline) to isolate the connection pipe 2522 from the connection wire. Therefore, the condensed water on the indoor heat exchanger 1 can be prevented from flowing to the connection wires, and the connection wires can be prevented from being corroded by the condensed water, which is beneficial to reduce potential safety hazards and improve the user experience.

Figure 32:
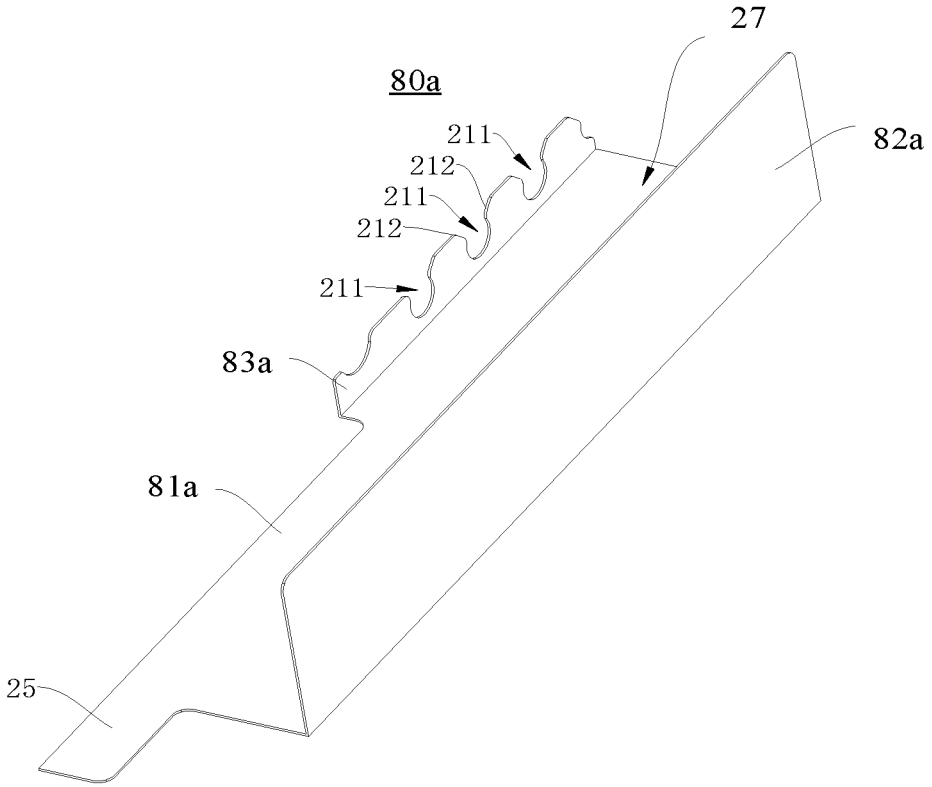
FIG. 32 is a structural schematic view of the water-blocking structure of the window air conditioner shown in FIG. 28.
Figure 33:
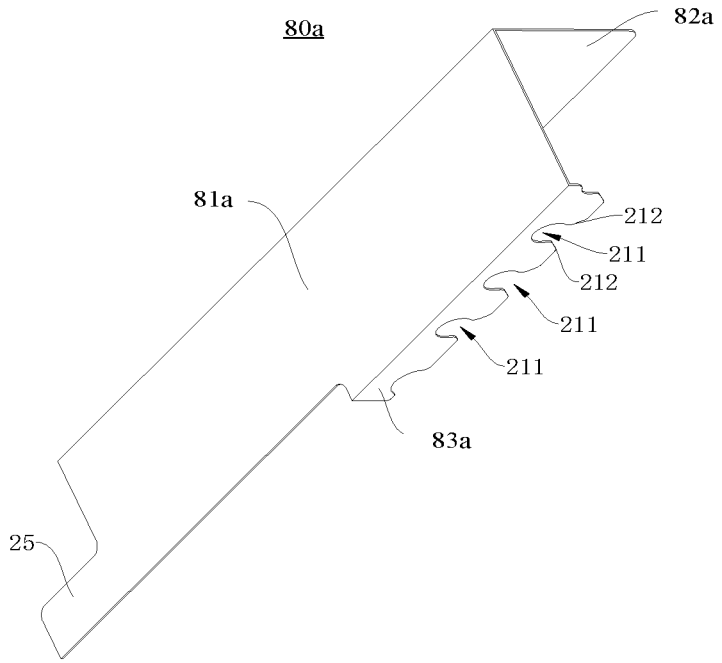
FIG. 33 is a schematic view of the water-blocking structure shown in FIG. 32 from another perspective.

As shown in FIG. 28, FIG. 32 and FIG. 33, the water baffle structure 80*a* is located on one side of the heat exchanger body 11 (refer to FIG. 28, the water baffle structure 80*a* is located on the left side of the heat exchanger body 11). As shown in FIG. 33, the water baffle structure 80*a* includes a water-blocking connection member 83*a*, a water-blocking side plate 82*a* and a water-blocking main plate 81*a*. The water-blocking connection member 83*a* and the water-blocking side plate 82*a* are spaced apart in the left-right direction and disposed opposite to each other, and the water-blocking connection member 83*a* is located between the water-blocking side plate 82*a* and one end of the heat exchanger body 11 (refer to FIG. 29). The water-blocking connection member 83*a* is provided with a clamp groove 211. The water-blocking main plate 81*a* is connected between the front end of the water-blocking connection member 83*a* and the front end of the water-blocking side plate 82*a* to form the accommodation space 27 with the water-blocking connection member 83*a* and the water-blocking side plate 82*a*. A portion of the connection pipe 2522 is located in the accommodation space 27 and extends in the up-down direction (refer to FIG. 30).

Therefore, a portion of the connection pipe 2522 is located in the accommodation space 27 formed by the water-blocking connection member 83*a*, the water-blocking side plate 82*a* and the water-blocking main plate 81*a*, which can improve the shielding effect of the water baffle structure 80*a* on the connection pipe 2522. The accommodation space 27 can prevent the cooling energy generated by one end of the heat exchanger body 11 from diffusing outward, which is beneficial to prevent the casing 37 of the window air conditioner 1000 from generating condensed water, and beneficial to further reduce the hidden danger of safety. The water baffle structure 80*a* has a simple structure and low production cost.

In some embodiments of the present disclosure, the clamp groove 211 is formed in a U shape. For example, as shown in FIG. 32 and FIG. 33, the clamp groove 211 is formed in a U shape and is clamped to the outer peripheral wall of the elbow member 111. The open end of the clamp groove 211 is provided with two guide slopes 212. In a direction away from the center of the clamp groove 211, the two guide slopes 212 extend in a direction away from each other. Therefore, it is convenient to clamp the water baffle structure 80*a* to the elbow member 111, and the structure of the clamp groove 211 is simple, which is convenient for processing and forming.

Figure 30:
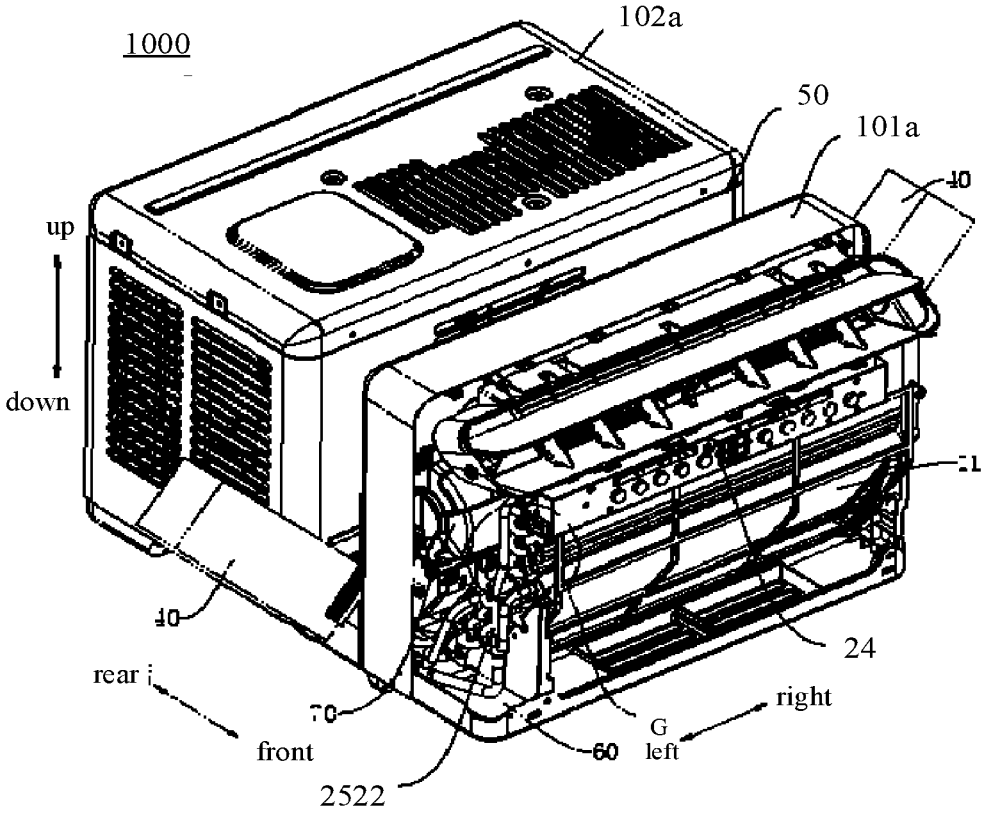
FIG. 30 is a partial schematic structural view of the window air conditioner shown in FIG. 28 from another perspective, wherein the water-blocking structure is removed.
Figure 31:
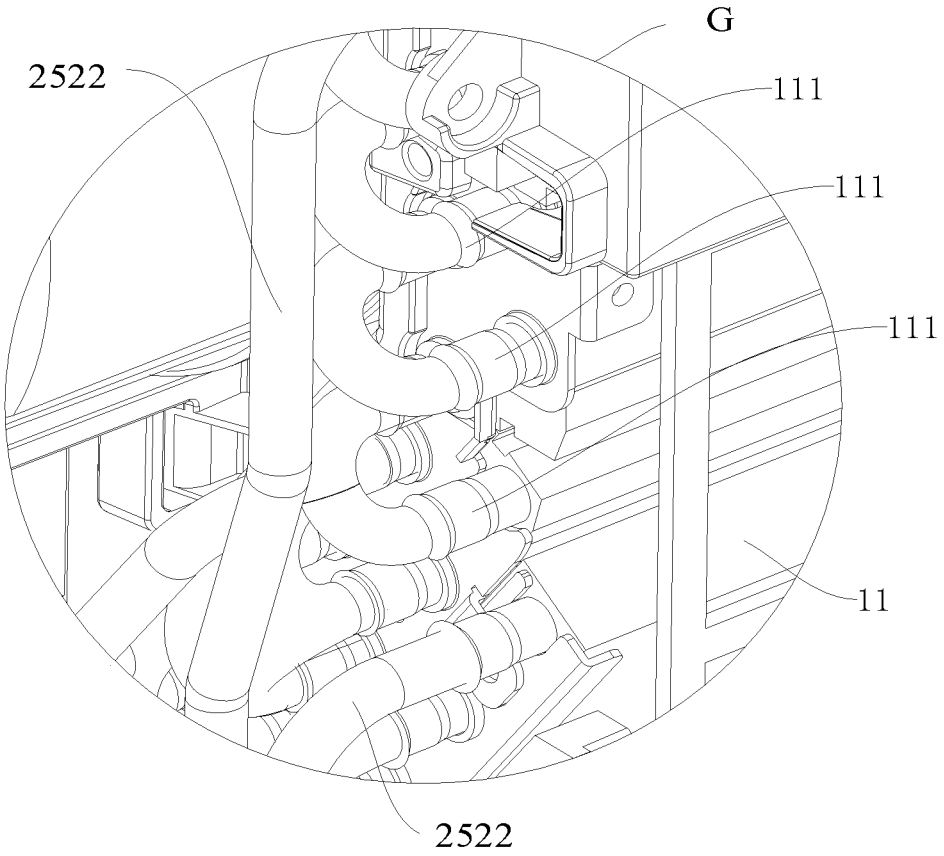
FIG. 31 is an enlarged schematic view of portion G in FIG. 30.

In some embodiments of the present disclosure, as shown in FIG. 32 and FIG. 33, a plurality of elbow members 111 spaced apart are provided, a plurality of clamp grooves 211 spaced apart are provided, and the plurality of clamp grooves 211 are respectively clamped with the corresponding elbow members 111. For example, as shown in FIG. 30 and FIG. 32, the water baffle structure 80*a* is provided with three clamp grooves 211 spaced apart in the up-down direction. The three clamp grooves 211 are in a one-to-one correspondence with three of the plurality of elbow members 111 on the heat exchanger body 11. In this way, the plurality of clamp grooves 211 are respectively clamped with the corresponding elbow members 111, which is beneficial to increase the contact area between the water baffle structure 80*a* and the heat exchanger body 11, thereby improving the reliability of the connection between the water baffle structure 80*a* and the heat exchanger body 11.

In some embodiments of the present disclosure, as shown in FIG. 29 and FIG. 32, the water baffle structure 80*a* further includes a deflector 25, and the deflector 25 is connected to the lower end of the water-blocking main plate 81*a* and extends downward. The width of the deflector 25 is smaller than the width of the water-blocking main plate 81*a*. It can be understood that, as shown in FIG. 29, the lower end of the heat exchanger assembly 1000*a* is provided with a water pan 60, and the lower end of the deflector 25 extends into the water pan 60 of the window air conditioner 1000.

The inventor also found in the actual research that, in the window air conditioner in the related art, the condensed water on the connection wire is easy to flow to the chassis, and there is noise. Especially for window air conditioners with the hollow part in the chassis, the condensed water on the connection wire may also flow directly to the ground on the indoor side of the window air conditioner through the hollow part on the chassis, which greatly reduces the user experience. However, according to the heat exchanger assembly 1000*a* of the window air conditioner 1000 of the embodiment of the present disclosure, the water baffle structure 80*a* shields the connection pipe 2522 to isolate the connection pipe 2522 from the connection wire, so that the condensed water on the heat exchanger 1 can be prevented from flowing to the connection wire, to prevent the connection wires from being corroded by condensed water, at the same time, the condensed water on the water baffle structure 80*a* can flow to the indoor water pan 60 along the deflector 25, such that the condensed water can be prevented from dripping onto the chassis or the ground on the indoor side of the window air conditioner, which is beneficial to reduce potential safety hazards, reduce noise, and further improve user experience.

In some embodiments of the present disclosure, the water baffle structure 80*a* is a transparent member. For example, the water baffle structure 80*a* is made of a transparent plastic material. Therefore, the working condition of the connection pipe 2522 of the heat exchanger 1 can be seen without removing the water baffle structure 80*a*, which is beneficial to reduce the maintenance cost of the heat exchanger assembly 1000*a*.

It can be understood that, with reference to the above description, the above-mentioned water baffle structure 80*a* can also be applied to an outdoor heat exchanger, which will not be repeated herein.

Figure 34:
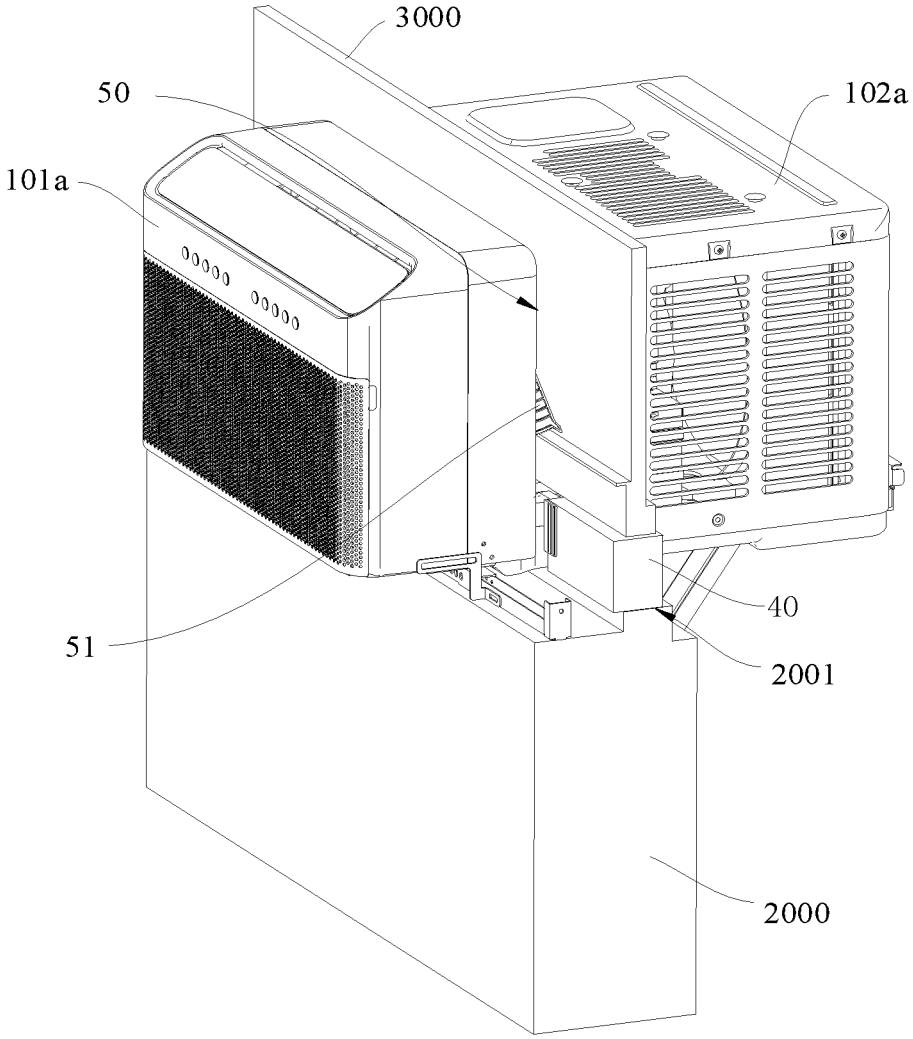
FIG. 34 is a schematic view of the window air conditioner shown in FIG. 28 when it is installed at a window.

As shown in FIG. 34, according to the window air conditioner 1000 of the embodiment of the present disclosure, the window air conditioner 1000 is suitable for being supported on the window 2001 of the wall 2000. A movable shielding member 3000 is provided in the window 2001, and the window air conditioner 1000 includes a casing 37 and the heat exchanger assembly 1000*a* according to the above-mentioned embodiment of the present disclosure. The outer peripheral wall of the casing 37 is provided with a partition groove 50. The casing 37 is divided into an indoor housing 101*a* and an outdoor housing 102*a* arranged in the front-rear direction through the partition groove 50. At least a part of the shielding member 3000 can extend into the partition groove 50, and the heat exchanger assembly 1000*a* is located in the indoor housing 101*a*.

In an example of the present disclosure, as shown in FIG. 30, the indoor housing 101*a* is further provided with an indoor fan 70 and a display box 24, and the heat exchanger assembly 10 is located between the indoor fan 70 and the heat exchanger assembly 10. The connection wire of the display box 24 bypasses the water baffle structure 80*a* and is connected to the indoor fan 70, such that the water baffle structure 80*a* can shield the refrigerant connection pipe 12 to isolate the refrigerant connection pipe 12 from the connection wires, Therefore, the condensed water on the heat exchanger 1 can be prevented from flowing onto the connection wires, and the connection wires can be prevented from being corroded by the condensed water, which is beneficial to reduce potential safety hazards and improve the user experience.

In an embodiment of the present disclosure, as shown in FIG. 30, the partition groove 50 is recessed downward from the top wall of the casing 37. Therefore, not only can the force of the window air conditioner 1000 be more uniform, but also the top wall of the window air conditioner 1000 can be prevented from being damaged due to a large force, which is beneficial to improve the installation reliability and working performance of the window air conditioner 1000. Moreover, the air outlet of the window air conditioner 1000 can be set at a higher position, which is convenient for the outlet air to flow in the indoor space, and is convenient to improve the temperature regulation efficiency of the window air conditioner 1000, and is convenient to improve the indoor temperature regulation effect of the window air conditioner 1000.

According to the window air conditioner 1000 of the embodiment of the present disclosure, by providing the heat exchanger assembly 10 according to the above-mentioned embodiment of the present disclosure, the condensed water on the indoor heat exchanger 1 can be prevented from flowing to the connection wires, and the connection wires can be prevented from being corroded by the condensed water, which is beneficial to reduce potential safety hazards and improve the user experience.

Figure 35:
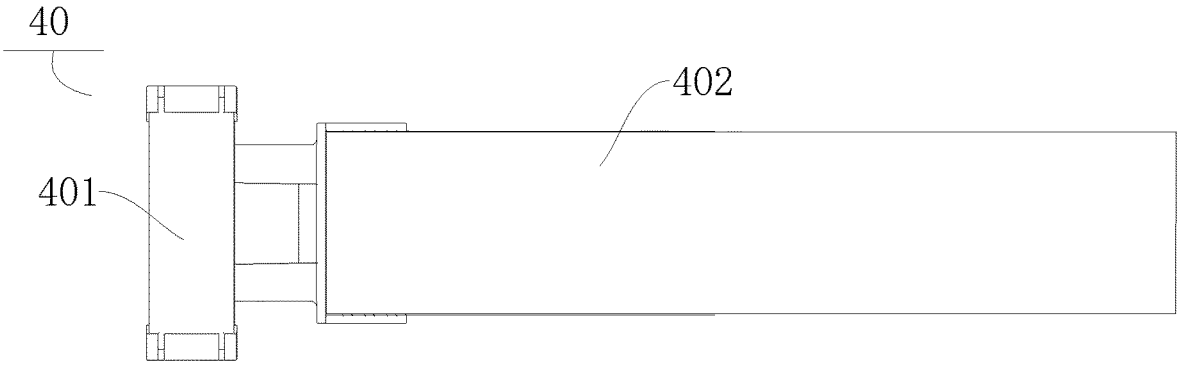
FIG. 35 is a schematic structural view of a sealing member of the window air conditioner shown in FIG. 28.

In some embodiments of the present disclosure, as shown in FIG. 34 and FIG. 35, the window air conditioner 1000 further includes a sealing member 40, and the sealing member 40 is adapted to be in contact with the inner wall of the shielding member 3000 and the window 2001, respectively. The sealing member 40 includes a fixation member 401 and a sealing component 402. The fixation member 401 is connected to the casing 37, the sealing component 402 is connected to the fixation member 401, and the sealing component 402 is sealed between the shielding member 3000 and the inner wall of the window 2001.

It can be understood that the sealing component 402 can be connected to the casing 37 through the fixation member 401. When the shielding member 3000 closes the window 2001, one side of the sealing component 402 is in contact with the shielding member 3000, and the other side of the sealing component 402 is in contact with the inner wall of the window 2001. The window 2001 is sealed by the sealing component 402, on the one hand, the sealing performance of the sealing member 40 is improved, and on the other hand, the sealing member 40 has a good sound insulation effect.

In some embodiments of the present disclosure, the sealing component 402 is a sealing sponge. The length of the sealing component 402 can be cut on site according to the distance between the side wall surface of the casing 37 and the inner wall surface of the window 2001, such that the sealing component 402 can better seal the window 2001, and while ensuring the sealing of the window 2001, the structure of the sealing member 40 is simpler.

In some embodiments of the present disclosure, the sealing component 402 can be made of polyvinyl alcohol (PVA) material, so that the sealing member 40 has unique strong adhesion, film flexibility, smoothness, oil resistance, solvent resistance, protective colloid property, gas barrier property, abrasion resistance and water resistance through special treatment, which can prevent external rainwater from entering the room and improve the waterproofness of the sealing member 40.

In some embodiments of the present disclosure, as shown in FIG. 34, the window air conditioner 1000 further includes a positioning device 51. The positioning device 51 has an unlocked state and a locked state. In the unlocked state, the positioning device 51 is disengaged from the shielding member 3000, and in the locked state, the positioning device 51 is in contact with the shielding member 3000 to position the shielding member 3000. It can be understood that the positioning device 51 can realize the positioning and locking of the shielding member 3000, which is beneficial to improve the sealing and safety. For example, in some embodiments of the present disclosure, the positioning device 51 can be rotated to lock the shielding member 3000 or unlock the shielding member 3000, so that the structure of the positioning device 51 is simpler and more reliable.

Figure 40:
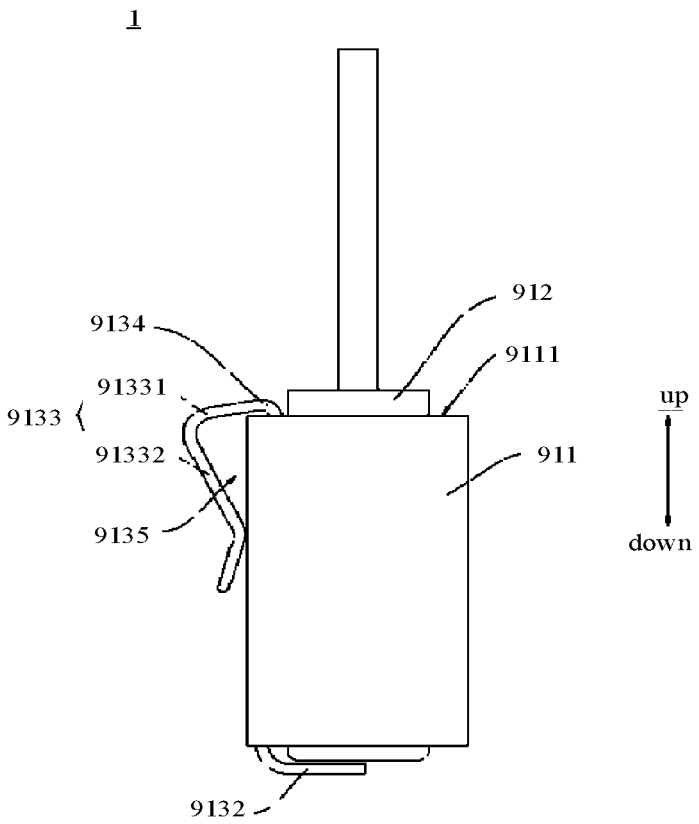
FIG. 40 is a schematic view of a temperature detection assembly of the window air conditioner shown in FIG. 36.
Figure 41:
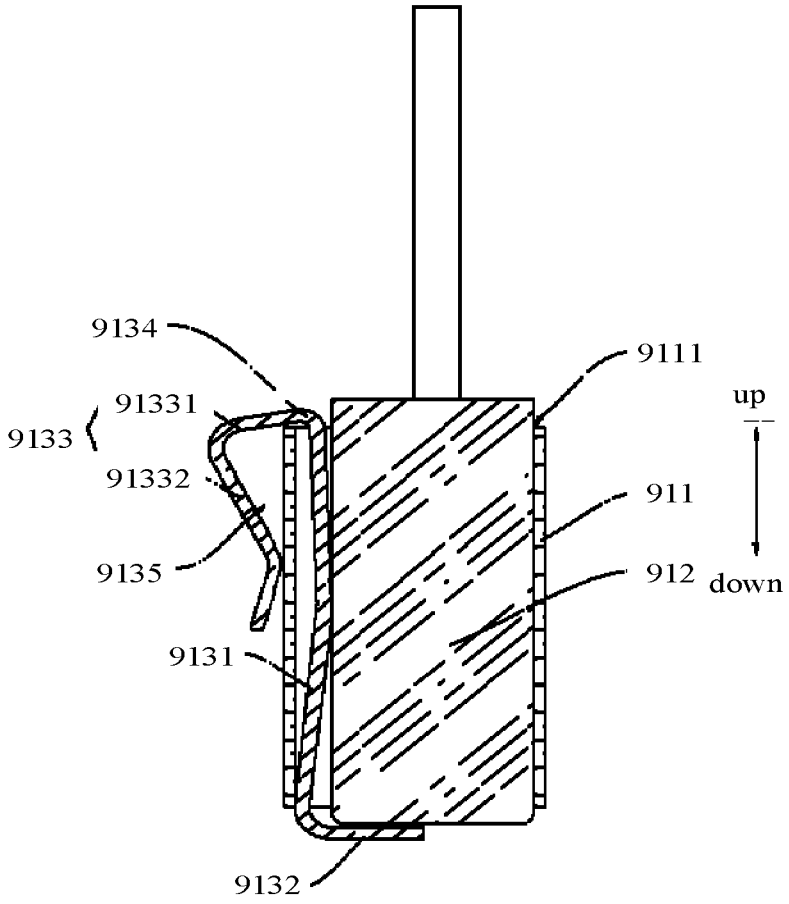
FIG. 41 is a cross-sectional view of the temperature detection assembly shown in FIG. 40.
Figure 42:
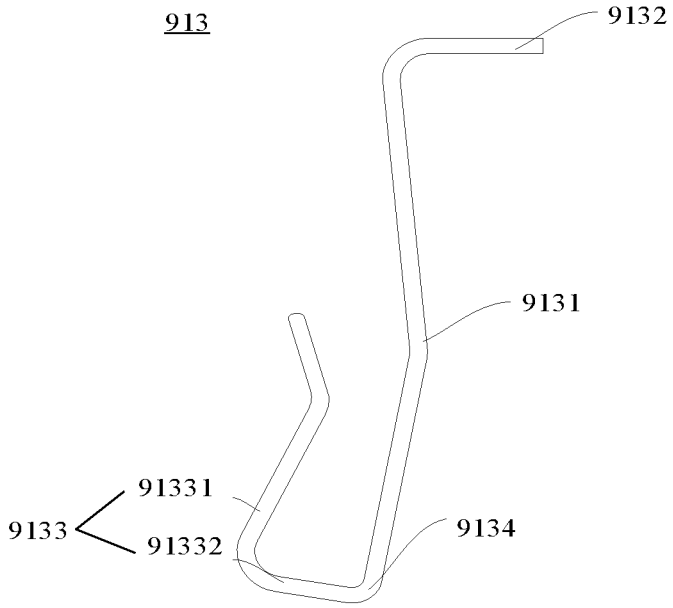
FIG. 42 is a schematic view of a fixation member of the temperature detection assembly shown in FIG. 40.

As shown in FIG. 40 to FIG. 42, the temperature detection assembly 91 according to the embodiment of the present disclosure includes a fixation shell 911, a temperature detection member 912 and a fixation member 913. The fixation shell 911 is a thermally conductive member, for example, the fixation shell 911 is a copper member with good thermal conductivity and structural strength. The temperature detection member 912 is provided in the fixation shell 911 and is in contact with the fixation shell 911, so that the fixation shell 911 can protect the temperature detection member 912. When the fixation shell 911 is in contact with the object to be measured, since the fixation shell 911 is a heat conduction member, the fixation shell 911 can conduct the heat of the object to be measured to the temperature detection member 912, the temperature of the fixation shell 911 is approximately the same as the temperature of the measured object, the temperature detection member 912 can measure the temperature of the fixation shell 911 by contacting the fixation shell 911, that is, to measure the temperature of the object to be measured, so that the temperature detection member 912 can accurately measure the temperature. For example, when the temperature detection assembly 91 is used to detect the temperature of the heat exchanger in the air conditioner, the temperature detection assembly 91 can be connected to the refrigerant pipe of the heat exchanger by welding. The welding connection makes the fixation shell 911 fully contact with the refrigerant pipe, which can improve the authenticity and accuracy of the temperature measurement of the temperature detection member 912. When the air conditioner is operating, the temperature of the refrigerant pipe is transmitted to the temperature detection member 912 through the fixation shell 911, and the temperature detection member 912 can detect the temperature of the refrigerant pipe.

The fixation shell 911 has an installation port 9111 for removing and installing the temperature detection member 912, so that the temperature detection member 912 can be removed and installed by passing through the installation port 9111, and the dismounting and mounting are simple. The fixation member 913 is provided at the fixation shell 911, and the fixation member 913 is used to detachably fix the temperature detection member 912 in the fixation shell 911, so that the temperature detection member 912 can be easily removed and installed, and the temperature detection member 912 can be easily replaced and maintained.

When installing the temperature detection member 912, the temperature detection member 912 passes through the installation port 9111, and the fixation member 913 is used to fix the temperature detection member 912 in the fixation shell 911, and the temperature detection member 912 is in contact with the fixation shell 911. When disassembling the temperature detection member 912, the temperature detection member 912 passes through the installation port 9111 to take out the temperature detection member 912, and the fixation shell 911 can still be connected to the object to be measured, which is convenient for the next installation of the temperature detection member 912.

According to the present disclosure, the fixation shell 911 is a heat conduction member, and the temperature detection member 912 is provided in the fixation shell 911 and is in contact with the fixation shell 911. When the fixation shell 911 is in contact with the object to be measured, the temperature detection member 912 can measure the temperature of the object to be measured by contacting the fixation shell 911, and the temperature measurement is accurate. The fixation member 913 is used to detachably fix the temperature detection member 912 in the fixation shell 911, so that the temperature detection member 912 can be easily removed and installed, and the temperature detection member 912 can be easily replaced and maintained.

As shown in FIG. 40 to FIG. 42, according to some embodiments of the present disclosure, the fixation member 913 is an elastic fixation member 913, and the fixation member 913 elastically presses the temperature detection member 912 into the fixation shell 911. The elastic deformation of the fixation member 913 facilitates the removing of the temperature detection member 912. While ensuring that the fixation member 913 can effectively fix the temperature detection member 912 in the fixation shell 911, the difficulty of removing and installing the temperature detection member 912 is further reduced, and the replacement and maintenance of the temperature detection member 912 is convenient.

As shown in FIG. 40 to FIG. 42, the fixation member 913 includes an elastic press member 9131. The elastic press member 9131 is located in the fixation shell 911, and at least a part of the elastic press member 9131 is bent toward the temperature detection member 912 to elastically press the temperature detection member 912 in the fixation shell 911. For example, a part of the elastic press member 9131 is bent toward the temperature detection member 912 to elastically press the temperature detection member 912 in the fixation shell 911. Alternatively, the entire elastic press member 9131 is bent toward the temperature detection member 912 to elastically press the temperature detection member 912 in the fixation shell 911. The elastic press member 9131 elastically compresses the temperature detection member 912 in the fixation shell 911, so that the fixation member 913 elastically compresses the temperature detection member 912 in the fixation shell 911, and the structure is simple.

As shown in FIG. 40 to FIG. 42, further, the fixation member 913 includes a support member 9132, the support member 9132 is connected to the lower end of the elastic press member 9131, and the temperature detection member 912 is supported on the support member 9132. By providing the support member 9132, the support member 9132 can carry the temperature detection member 912, so as to prevent the temperature detection member 912 from falling off from the fixation shell 911. The temperature detection member 912 is in contact with the support member 9132, and the support member 9132 will not affect the removing and installing of the temperature detection member 912. While ensuring the structural stability of the temperature detection assembly 91, the removing and installing of the temperature detection member 912 is facilitated.

As shown in FIG. 40 to FIG. 42, further, the installation port 9111 is located at the top of the fixation shell 911, and the bottom of the fixation shell 911 is open. This design allows the temperature detection member 912 to pass through the installation port 9111 in the up-down direction to realize removing and installing. When the temperature detection member 912 is installed in the fixation shell 911, the temperature detection member 912 is supported on the support member 9132 and will not fall off from the open bottom of the fixation shell 911. Besides, since the bottom of the fixation shell 911 is open, the fixation shell 911 is suitable for the temperature detection members 912 and 913 of different specifications to be accommodated in the fixation shell 911. For example, the size of some temperature detection members 912 in the vertical direction is slightly larger than that of the fixation shell 911, so that the top of the temperature detection member 912 can be higher than the top of the fixation shell 911, and the bottom of the temperature detection member 912 can be extended from the bottom of the fixation shell 911. Since the fixation member 913 can still elastically press the temperature detection member 912 in the fixation shell 911, the temperature detection member 912 of different specifications can be effectively fixed in the fixation shell 911. On the other hand, when disassembling the temperature detection member 912, the operator can extend his finger upwards from the open bottom of the fixation shell 911 to push the temperature detection member 912 upwards to facilitate the removing of the temperature detection member 912.

In some embodiments of the present disclosure, the installation port 9111 is located at the top of the fixation shell 911 and the bottom of the fixation shell 911 is closed. This design prevents the temperature detection member 912 from falling off the bottom of the fixation shell 911 when the temperature detection member 912 is installed in the fixation shell 911.

As shown in FIG. 40 to FIG. 42, according to some embodiments of the present disclosure, the fixation member 913 is detachably provided at the fixation shell 911, and the fixation member 913 includes a buckle member 9133. The buckle member 9133 is connected to the upper end of the elastic press member 9131 and protrudes outward (the outward refers to the direction away from the center of the fixation shell 911) to the outside of the fixation shell 911. By arranging the buckle member 9133, when the temperature detection member 912 is being removed, the operator can take out the fixation member 913 and the temperature detection member 912 from the fixation shell 911 by lifting the buckle member 9133, which is convenient for removing and can reduce the number of times the operator directly contacts the temperature detection member 912.

As shown in FIG. 40 to FIG. 42, further, the buckle member 9133 is connected to the elastic press member 9131 through the connection member 9134, and the connection member 9134 is supported on the fixation shell 911. Therefore, the buckle member 9133 can be reliably supported on the fixation shell 911, and this design realizes that the fixation member 913 can be detachably provided at the fixation shell 911.

According to some embodiments of the present disclosure, the installation port 9111 is located at the top of the fixation shell 911, and the bottom of the fixation shell 911 is open. The fixation member 913 is detachably provided at the fixation shell 911, and the fixation member 913 includes a buckle member 9133, and the buckle member 9133 is connected to the upper end of the elastic press member 9131 and protrudes outward to the outside of the fixation shell 911. The buckle member 9133 is connected to the elastic press member 9131 through the connection member 9134, and the connection member 9134 is supported on the fixation shell 911. When the elastic press member 9131 elastically presses the temperature detection member 912 in the fixation shell 911, the connection member 9134 is supported on the fixation shell 911 to prevent the fixation member 913 and the temperature detection member 912 from falling from the open bottom of the fixation shell 911.

As shown in FIG. 40 to FIG. 42, according to some embodiments of the present disclosure, the buckle member 9133 includes a first buckle section 91331 and a second buckle section 91332, the first buckle section 91331 is connected to the upper end of the elastic press member 9131, and the first buckle section 91331 extends outward. By providing the first buckle section 91331, when disassembling the temperature detection member 912, the operator can take out the fixation member 913 and the temperature detection member 912 from the fixation shell 911 by lifting the first buckle section 91331, which is convenient for removing. The second buckle section 91332 is connected to the end of the first buckle section 91331 away from the elastic press member 9131, the second buckle section 91332 extends downward. At least a part of the second buckle section 91332 is spaced apart from the fixation shell 911 to form a buckle space 9135. For example, a part of the second buckle section 91332 is spaced apart from the fixation shell 911 to form the buckle space 9135. Alternatively, the second buckle section 91332 is entirely spaced from the fixation shell 911 to form the buckle space 9135. When disassembling or replacing the temperature detection member 912, the operator can put his finger into the buckle space 9135 to control the up and down movement of the fixation member 913 and the temperature detection member 912 supported on the support member 9132, which facilitates the removing and installing of the temperature detection member 912.

As shown in FIG. 40 to FIG. 42, further, the second buckle section 91332 is bent toward the fixation shell 911 to be elastically pressed on the fixation shell 911. When the temperature detection member 912 is fixed in the fixation shell 911, the second buckle section 91332 is pressed on the fixation shell 911, and the fixing strength of the fixation member 913 on the fixation shell 911 can be further improved while the fixation member 913 is detachably provided at the fixation shell 911.

As shown in FIG. 41, in some embodiments of the present disclosure, the fixation shell 911 is in the shape of a circular tube, the temperature detection member 912 is roughly cylindrical, and the radius of the fixation shell 911 is slightly larger than the radius of the temperature detection member 912. For example, the radius of the fixation shell 911 is 0.8-1.5 mm larger than the radius of the temperature detection member 912, and the fixation member 913 can fix the temperature detection member 912 in the fixation shell 911 by elastically pressing the temperature detection member 912.

As shown in FIG. 40 to FIG. 42, according to some embodiments of the present disclosure, the fixation member 913 is a plastic member, and this design enables the fixation member 913 to have good elastic deformation ability, low cost, and easy production.

As shown in FIG. 40 to FIG. 42, according to some embodiments of the present disclosure, the fixation shell 911 is a metal member, so that the fixation shell 911 has good structural strength and thermal conductivity, which improves the temperature measurement accuracy of the temperature detection member 912. For example, the fixation shell 911 is a copper member.

Figure 36:
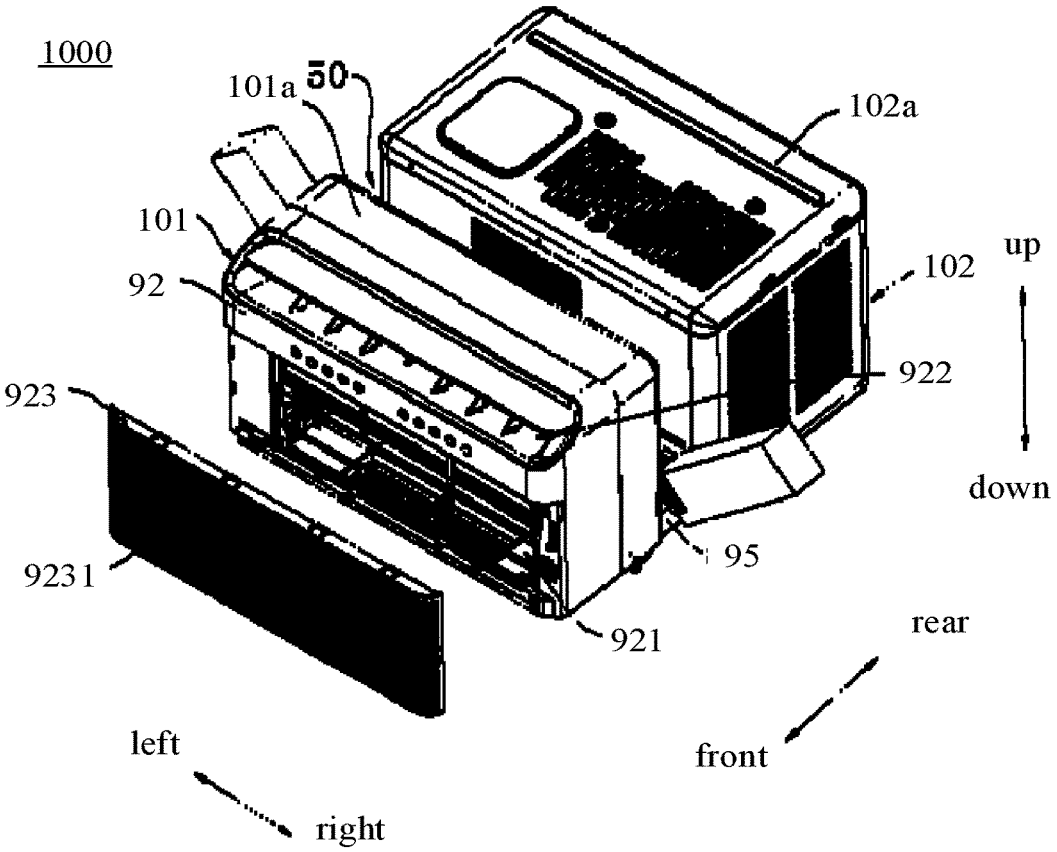
FIG. 36 is an exploded view of the window air conditioner according to yet another embodiment of the present disclosure.
Figure 37:
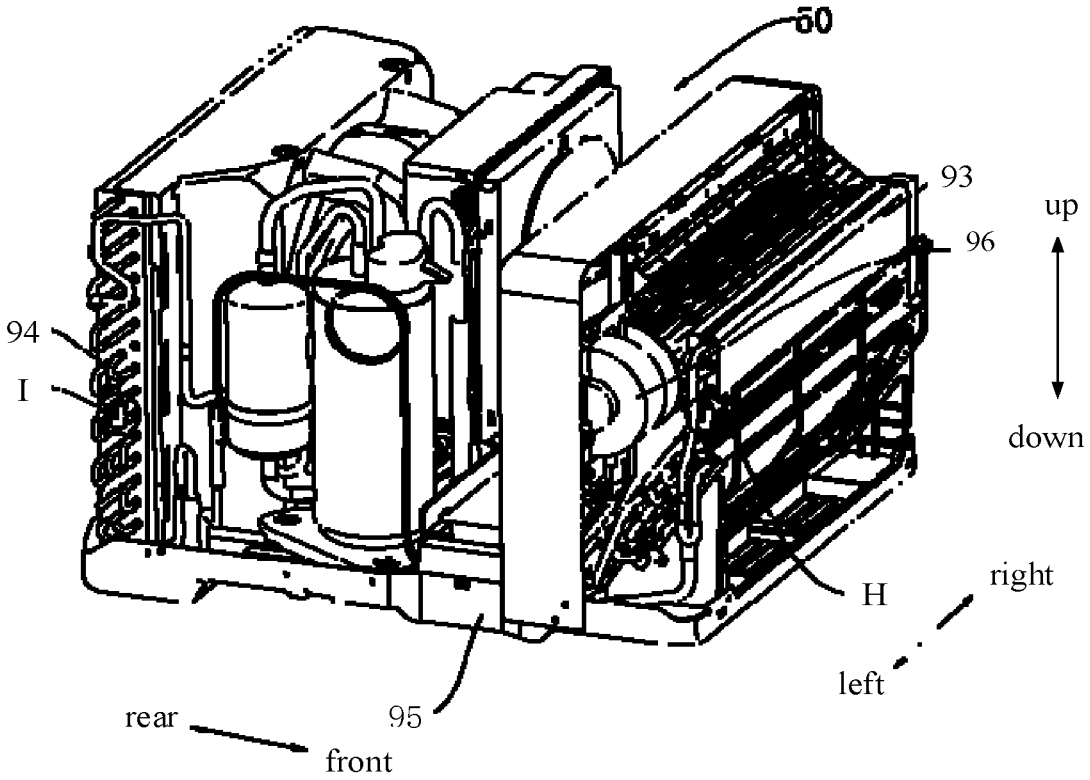
FIG. 37 is a partial schematic structural view of the window air conditioner shown in FIG. 36.

As shown in FIG. 36 and FIG. 37, the air conditioner according to the embodiment of the second aspect of the present disclosure includes the temperature detection assembly 91 according to the embodiment of the first aspect of the present disclosure. The temperature detection assembly 91 can measure the temperature of a certain component of the air conditioner. For example, the temperature detection assembly 91 is disposed at the air inlet 921 of the air conditioner to measure the temperature of the intake air (i.e., the indoor temperature). The temperature detection assembly 91 can also be provided at the evaporator 93 of the air conditioner to detect the temperature of the evaporator 93, and when the air conditioner is cooling, the electric control assembly of the air conditioner can determine whether the temperature of the evaporator 93 is too low, and when the electric control component detects that the temperature of the evaporator 93 is too low, the electric control assembly controls to reduce the refrigeration power of the refrigeration system or control the refrigeration system of the air conditioner to stop working, thereby preventing the evaporator 93 from frosting.

According to the air conditioner of the present disclosure, the temperature detection assembly 91 can measure the temperature of a certain component of the air conditioner through contact, and the temperature measurement is accurate, and the temperature detection assembly 912 is easy to be removed and installed, so as to facilitate the replacement and maintenance of the temperature detection assembly 912.

Figure 38:
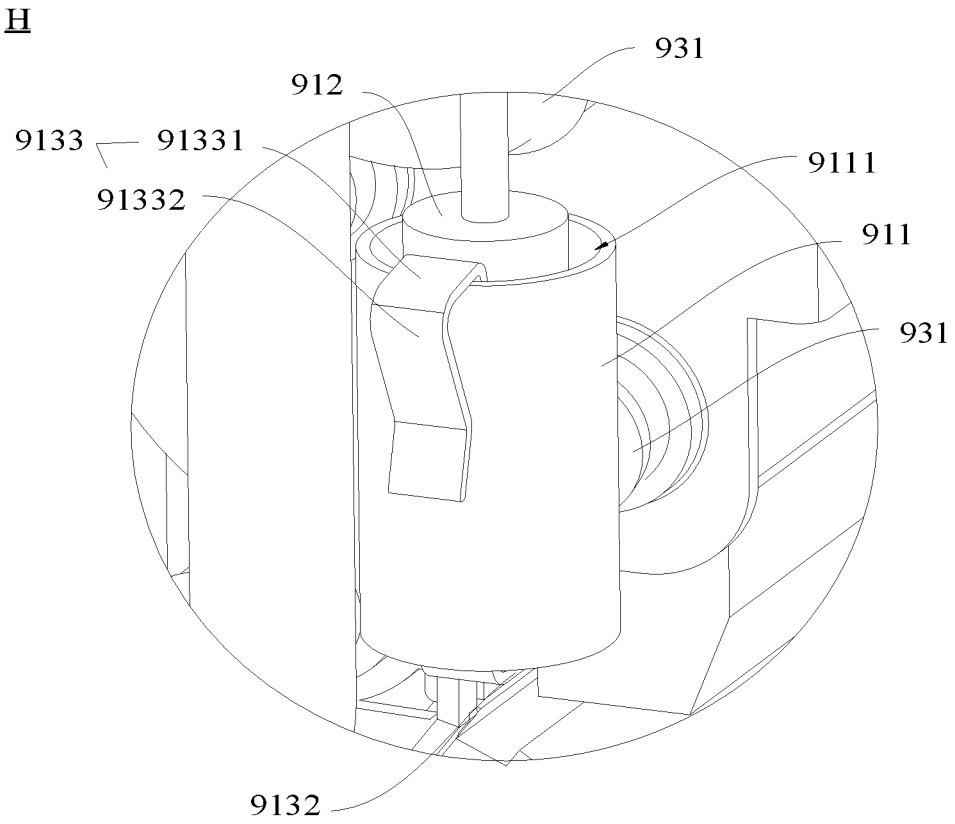
FIG. 38 is an enlarged view of portion H in FIG. 37.
Figure 39:
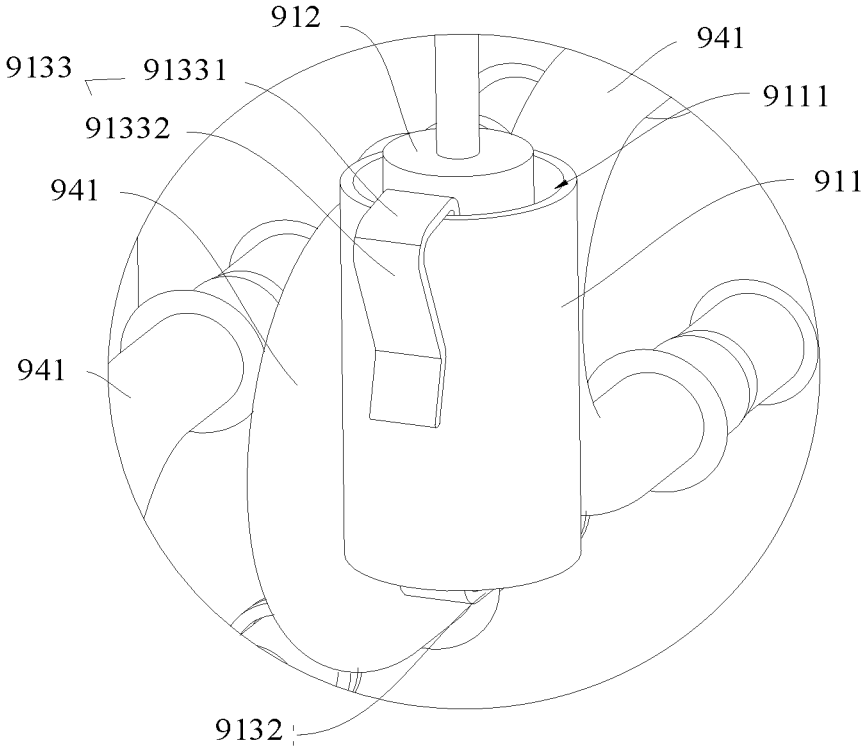
FIG. 39 is an enlarged view of portion I in FIG. 37.

As shown in FIG. 37 to FIG. 39, according to some embodiments of the present disclosure, at least one of the evaporator 93 and the condenser 94 of the air conditioner is provided with the temperature detection assembly 91. For example, the evaporator 93 of the air conditioner is provided with the temperature detection assembly 91, and the temperature detection assembly 91 can detect the temperature of the evaporator 93. The evaporator 93 includes a plurality of evaporator fins and an evaporator refrigerant pipe 31. The plurality of evaporator fins are provided at the evaporator refrigerant pipe 31 at intervals in the left-right direction, and the temperature detection assembly 91 can be welded on the evaporator refrigerant pipe 31. The temperature detection assembly 91 is located at one end of the evaporator refrigerant pipe 31, so that the fins are not affected by the welding of the fixation shell 911 and the removing of the temperature detection member 912. Alternatively, the temperature detection assembly 91 is provided at the condenser 94 of the air conditioner, and the temperature detection assembly 91 can detect the temperature of the condenser 94. The condenser 94 includes a plurality of condenser fins and a condenser refrigerant pipe 941. The plurality of condenser fins are provided at the condenser refrigerant pipe 941 at intervals in the left-right direction, and the temperature detection assembly 91 can be welded on the condenser refrigerant pipe 941. The temperature detection assembly 91 is located at one end of the condenser refrigerant pipe 14, so that the welding of the fixation shell 911 and the removing of the temperature detection member 912 are not affected by the fins. The evaporator 93 of the air conditioner is provided with the temperature detection assembly 91, the condenser 94 of the air conditioner is provided with the temperature detection assembly 91, and the two temperature detection assemblies 91 can measure the temperature of the evaporator 93 and the condenser 94 respectively.

As shown in FIG. 36 and FIG. 37, according to some embodiments of the present disclosure, the air conditioner is a window air conditioner 1000, and a temperature detection assembly 91 can be provided at the evaporator 93 of the window air conditioner 1000 to detect the temperature of the evaporator 93. The temperature detection assembly 91 may be provided at the condenser 94 of the window air conditioner 1000 to detect the temperature of the condenser 94.

In some embodiments of the present disclosure, the window air conditioner 1000 includes a chassis 95, an indoor portion 101 and an outdoor portion 102, and both the indoor portion 101 and the outdoor portion 102 are provided at the chassis 95. The indoor portion 101 includes an indoor housing 101*a*, an evaporator 93 and an indoor fan 96. The outdoor portion 102 includes an outdoor housing 102*a*, a condenser 94, and an outdoor fan. The indoor housing 101*a* includes a face frame 92, an indoor sub-housing and an air inlet panel 923, and the indoor sub-housing is connected to the rear side of the face frame 92. The face frame 92, the indoor sub-housing and the chassis 95 form an installation cavity. The evaporator 93 and the indoor fan 96 are provided in the installation cavity, and the temperature detection assembly 91 is provided at the evaporator 93. The indoor fan 96 includes an impeller and a motor, and the motor can drive the impeller to rotate. An air inlet 921 and an air outlet 922 are formed at the face frame 92, an air inlet panel 923 is provided at the air inlet 921, and a ventilation structure 9231 is formed at the air inlet panel 923 which communicates with the air inlet 921. The ventilation structure 9231 may be a plurality of ventilation holes formed at the air inlet panel 111. The indoor fan 96 can drive the indoor air to enter the window air conditioner 1000 from the air inlet 921 and exchange heat with the evaporator 93, and the outlet air of the window air conditioner 1000 can be discharged from the air outlet 922. The condenser 94 and the outdoor fan are provided in the outdoor housing 102*a*, and the temperature detection assembly 91 is provided at the condenser 94.

As shown in FIG. 36 and FIG. 37, according to some embodiments of the present disclosure, the window air conditioner 1000 is suitable for being supported on the window of the wall, and a movable shielding member is provided in the window, and the window air conditioner 1000 has a partition groove 50. At least a part of the shielding member is adapted to extend into the partition groove 50. This design makes the window air conditioner 1000 easy to be installed, and the movable shielding member matches the partition groove 50, so that the installation place of the window air conditioner 1000 is sealed and the window air leakage is reduced.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. A window air conditioner comprising:
a chassis;
an indoor water pan installed at the chassis;
a support frame provided at the chassis or the indoor water pan;
an indoor heat exchanger installed at the support frame and located above the indoor water pan; and
an indoor air duct shell installed at the indoor heat exchanger;
wherein:
the indoor heat exchanger is located between the support frame and the indoor air duct shell;
the indoor heat exchanger includes a heat exchanger body and a side plate provided at the heat exchanger body;
the side plate includes a side plate body formed with matching holes matching refrigerant pipes of the heat exchanger;
a periphery of one matching hole of the matching holes is formed with a protective protrusion located at a side of the side plate body away from the heat exchanger body; and
the protective protrusion extends along a circumferential direction of the one matching hole, and a water leakage hole is formed at the protective protrusion.

2. The window air conditioner of claim 1, wherein the indoor heat exchanger further includes:
a heat exchanger shell;
a side plate structure including shell side plates arranged at both ends of the heat exchanger shell;
heat exchange fins installed at the shell side plates provided in the heat exchanger shell, the refrigerant pipes passing through the heat exchange fins; and
connection pipes protruding from an end of the heat exchanger shell, each of the connection pipes being connected to ends of two of the refrigerant pipes on a same side.

3. The window air conditioner of claim 2, wherein:
one shell side plate of the shell side plates is provided with a pipe installation hole;
a pipe installation ring protrudes from an outer side of the one shell side plate and surrounds the pipe installation hole, a bottom of the pipe installation ring being provided with an outer water guide groove, and a cavity formed by the pipe installation ring being communicated with outside through the outer water guide groove; and
one of the connection pipes:
passes through the pipe installation hole, or
passes through the pipe installation hole and is clamped in the pipe installation ring.

4. The window air conditioner of claim 3, wherein:
a bottom surface of the outer water guide groove is recessed on an outer surface of the one shell side plate;
a bottom surface of the outer water guide groove is flush with an outer surface of the one shell side plate;
a bottom surface of the outer water guide groove is a plane; or
a bottom surface of the outer water guide groove is an inclined surface inclined from the pipe installation hole to an outside of the pipe installation ring.

5. The window air conditioner of claim 3, wherein:
the pipe installation hole is one of a plurality of first pipe installation holes provided at the one shell side plate, and the pipe installation ring is one of a plurality of pipe installation rings each provided outside one of the plurality of first pipe installation holes;
the one shell side plate is further provided with a second pipe installation hole;
the connection pipes include:
one or more first connection pipes each installed in a corresponding first pipe installation hole and clamped in one pipe installation ring corresponding to the corresponding first pipe installation hole; and
a second connection pipe installed in the second pipe installation hole;
a bottom of each of the plurality of first pipe installation holes is provided with an inner water guide groove; and
the second pipe installation hole is communicated with one first pipe installation hole adjacent to the second pipe installation hole via the inner water guide groove of the one first pipe installation hole; or two adjacent first pipe installation holes are communicated with each other via the inner water guide grooves of the two adjacent first pipe installation holes, and one of the two adjacent first pipe installation holes is communicated with the second pipe installation hole that is adjacent to the one of the two adjacent first pipe installation holes via one of the inner water guide grooves of the two adjacent first pipe installation holes.

6. The window air conditioner of claim 1, wherein:
the support frame is detachably installed at the indoor water pan; or
the support frame is integrated with the indoor water pan.

7. The window air conditioner of claim 6, wherein the support frame includes two support ribs arranged at two sides of the indoor water pan, respectively, and two sides of the indoor heat exchanger are respectively installed at the two support ribs.

8. The window air conditioner of claim 1, wherein the support frame is inclined downward from an indoor side to an outdoor side, the indoor heat exchanger is installed at the support frame obliquely, and the indoor air duct shell is installed at the indoor heat exchanger obliquely.

9. The window air conditioner of claim 1, wherein:
the indoor air duct shell includes a shell connection plate connected to the indoor heat exchanger; and
one side of the indoor heat exchanger is connected to the support frame, and another side of the indoor heat exchanger is provided with a heat exchanger backboard detachably connected to the shell connection plate.

10. The window air conditioner of claim 1, wherein:
the water leakage hole is formed at a lowest position of the protective protrusion; or
the water leakage hole is a notch formed at the protective protrusion.

11. The window air conditioner of claim 1, wherein the side plate body includes a first sub-side plate body and a second sub-side plate body, an angle of 30°-50° is formed between the first sub-side plate body and the second sub-side plate body.

12. The window air conditioner of claim 1, further comprising:
a heat exchanger including a heat exchanger body and a pipeline communicated with the heat exchanger body; and a water-blocking structure connected to the heat exchanger body and configured to shield the pipeline to isolate the pipeline from a connection wire.

13. The window air conditioner of claim 1, further comprising:

a water baffle structure;

wherein:

a refrigerant connection pipe of the indoor heat exchanger is connected to one end of a heat exchanger body of the indoor heat exchanger along a left-right direction;

the one end of the heat exchanger body is provided with an elbow member, and the water baffle structure is provided with a clamp groove clamped with the elbow member.

14. The window air conditioner of claim 13, wherein the water baffle structure is located on one side of the one end of the heat exchanger body, and includes:

a water-blocking connection member and a water-blocking side plate spaced apart from each other in a left-right direction and arranged opposite to each other, the water-blocking connection member being located between the water-blocking side plate and the one end of the heat exchanger body, and the water-blocking connection member is provided with the clamp groove; and a water-blocking main plate connected between a front end of the water-blocking connection member and a front end of the water-blocking side plate to form an accommodation space with the water-blocking connection member and the water-blocking side plate, a portion of the refrigerant connection pipe being located in the accommodation space and extending in an up-down direction.

15. The window air conditioner of claim 14, wherein the water baffle structure further includes a deflector connected to a lower end of the water-blocking main plate and extending downward, and a width of the deflector is smaller than a width of the water-blocking main plate.

16. The window air conditioner of claim 1, further comprising:

a housing installed at the chassis;

an electric control box installed in the housing; and a display box installed at the housing and electrically connected to the electric control box via the connection wire.

17. The window air conditioner of claim 1, further comprising:

a temperature detection assembly including:

a fixation shell, the fixation shell being a heat-conduction member;

a temperature detection member provided in the fixation shell and in contact with the fixation shell, the fixation shell having an installation port for removing and installing the temperature detection member; and a fixation member provided at the fixation shell and configured to detachably fix the temperature detection member in the fixation shell.

18. The window air conditioner of claim 17, wherein the fixation member includes an elastic press member located in the fixation shell, and at least a part of the elastic press member is bent towards the temperature detection member to elastically press the temperature detection member in the fixation shell.

19. The window air conditioner of claim 18, wherein:

the fixation member is detachably provided at the fixation shell and includes a buckle member connected to an upper end of the elastic press member via a connection member and protruding outward to an outside of the fixation shell, the connection member being supported on the fixation shell; and the buckle member includes:

a first buckle section connected to the upper end of the elastic press member and extending outward; and a second buckle section connected to an end of the first buckle section away from the elastic press member and extending downward, at least a part of the second buckle section being spaced apart from the fixation shell to form a buckle space, and the second buckle section being bent toward the fixation shell to elastically press on the fixation shell.

20. A window air conditioner comprising:

a chassis;

an indoor water pan installed at the chassis;

a support frame provided at the chassis or the indoor water pan;

an indoor heat exchanger installed at the support frame and located above the indoor water pan;

an indoor air duct shell installed at the indoor heat exchanger; and a water baffle structure;

wherein:

the indoor heat exchanger is located between the support frame and the indoor air duct shell;

a refrigerant connection pipe of the indoor heat exchanger is connected to one end of a heat exchanger body of the indoor heat exchanger along a left-right direction;

the one end of the heat exchanger body is provided with an elbow member, and the water baffle structure is provided with a clamp groove clamped with the elbow member;

the water baffle structure is located on one side of the one end of the heat exchanger body, and includes:

a water-blocking connection member and a water-blocking side plate spaced apart from each other in a left-right direction and arranged opposite to each other, the water-blocking connection member being located between the water-blocking side plate and the one end of the heat exchanger body, and the water-blocking connection member is provided with the clamp groove; and a water-blocking main plate connected between a front end of the water-blocking connection member and a front end of the water-blocking side plate to form an accommodation space with the water-blocking connection member and the water-blocking side plate, a portion of the refrigerant connection pipe being located in the accommodation space and extending in an up-down direction.

* * * * *